US007914127B2

(12) United States Patent
Martina et al.

(10) Patent No.: US 7,914,127 B2
(45) Date of Patent: Mar. 29, 2011

(54) NOZZLE PLATE FOR AN INK JET PRINT HEAD COMPRISING STRESS RELIEVING ELEMENTS

(75) Inventors: Giancarlo Martina, Arnad (IT); Silvano Tori, Arnad (IT)

(73) Assignee: Telecom Italia S.p.A., Milan (IT)

( * ) Notice: Subject to any disclaimer, the term of this patent is extended or adjusted under 35 U.S.C. 154(b) by 224 days.

(21) Appl. No.: 11/921,392

(22) PCT Filed: May 31, 2005

(86) PCT No.: PCT/EP2005/005846
§ 371 (c)(1),
(2), (4) Date: Mar. 13, 2009

(87) PCT Pub. No.: WO2006/128482
PCT Pub. Date: Dec. 7, 2006

(65) Prior Publication Data

US 2009/0295869 A1 Dec. 3, 2009

(51) Int. Cl.
*B41J 2/045* (2006.01)

(52) U.S. Cl. ..... 347/71

(58) Field of Classification Search ..... 347/40, 347/43, 64, 65, 70, 71, 66, 67
See application file for complete search history.

(56) References Cited

U.S. PATENT DOCUMENTS

| | | | | |
|---|---|---|---|---|
| 5,847,725 | A | 12/1998 | Cleland et al. | |
| 5,988,786 | A | 11/1999 | Waller et al. | |
| 6,106,096 | A * | 8/2000 | Komplin et al. | 347/20 |
| 6,360,439 | B1 | 3/2002 | Cleland et al. | |
| 6,527,368 | B1 | 3/2003 | Giri et al. | |
| 6,799,831 | B2 | 10/2004 | Inamoto et al. | |
| 6,820,963 | B2 | 11/2004 | Stauffer et al. | |
| 7,600,856 | B2 * | 10/2009 | Lebens et al. | 347/56 |
| 2002/0041308 | A1 | 4/2002 | Cleland et al. | |

FOREIGN PATENT DOCUMENTS

| | | |
|---|---|---|
| EP | 0925932 | 6/1999 |
| EP | 1293343 | 3/2003 |
| WO | WO 2004/067280 | 12/2004 |

OTHER PUBLICATIONS

International Search Report dated May 9, 2006 issued in PCT/EP2005/005846.

* cited by examiner

*Primary Examiner* — Lamson D Nguyen
(74) *Attorney, Agent, or Firm* — Venable LLP; Robert Kinberg; Steven J. Schwarz

(57) ABSTRACT

The invention relates to an ink jet print head structure for printing devices, comprising a substrate in which one or more slots are realized and a nozzle plate connected to the substrate. The nozzle plate defines a first axis (X) and a second perpendicular axis (Y) and comprises a plurality of nozzles from which ink is ejected in fluid communication with the slots. The slots extends along the second axis (Y). A plurality of strip-like stress relief elements is realized on the nozzle plate, the plurality of stress relief elements is disposed so to extend along the Y axis, and each stress relief element of the plurality defines an aperture on a free surface of said nozzle plate. In addition, the total X projections of all apertures defined by the plurality of stress relief elements along the first (X) axis has a resulting length comprised between 10% and 55% of the overall width of the nozzle plate along the same first axis (X).

25 Claims, 17 Drawing Sheets

NOZZLE PLATE FOR AN INK JET PRINT HEAD COMPRISING STRESS RELIEVING ELEMENTS

CROSS-REFERENCE TO RELATED APPLICATIONS

This application is a National Stage of International Application No. PCT/EP2005/005846 filed May 31, 2005, designating the United States, the entire contents of which is incorporated herein by reference.

TECHNICAL FIELD

The present invention relates to an ink jet print head, in particular a composite print head structure, to discharge liquid such as ink toward a recording medium. In this head, mechanical and/or thermal stresses are reduced.

TECHNOLOGICAL BACKGROUND

Inkjet printing is usually accomplished by expelling droplets of ink from tiny orifices (nozzles) to land on a recording medium, such as paper. The most common technologies to spray ink from a print head are a thermal process and a mechanical process: in the first one ink is vaporized and thus expelled from the print head, while in the second a piezoelectric transducer is used. This mechanism may be used in a variety of applications, such as printers, plotters, copying machines and fax machines.

The print head is part of an ink cartridge, which physically contains the ink in one or more ink reservoir(s). A representative print head contains a series of nozzles from which the drops of ink are sprayed. A channel is provided to connect the ink reservoir(s) to the nozzles.

Ink cartridges come in various combinations, such as separate black and (multi-)colors cartridges, color and black in a single cartridge or even a cartridge for each ink color. Therefore, a plurality of different fluids may be ejected from the same print head. In such a head, typically each fluid is ejected from a group of closely spaced nozzles and the different groups of nozzles are spaced at a greater distance apart. For each group of nozzles a separated channel is present to connect them to the ink reservoir(s).

Typically, print heads are composite structures, including a semiconductor substrate, a polymeric microhydraulic layer and a metallic or plastic plate in which the nozzles are realized, referred in the following as "nozzle plate".

The bonding of the nozzle plate to the substrate is made using either an adhesive or by bonding the metallic or plastic plate to a polymeric layer in turn bonded to or deposited on the substrate layer. This polymeric layer serves as a barrier layer to avoid for example leakage of ink from one ink channel/nozzles to the other(s) and to define for each channel some functional fluidic parameters.

The micro-hydraulics layer, including the channel(s) connecting the nozzles to the ink reservoir(s) can be realized on the substrate to form an integral part thereof, whilst the nozzles to eject ink are formed in the metallic or plastic plate adhered to the substrate. Alternatively, the ink channels can be formed in the polymeric layer used to bond the nozzle plate to the substrate, or in the nozzle plate itself, in case the latter is made of polymeric material.

Polymeric nozzle plate integrally formed on the semiconductor substrate can be also realized and, in that case, the print head is referred to as monolithic print head.

In the following, unless otherwise specified, the term "substrate" will be used to designate the assembly of the semiconductor substrate and the micro-hydraulics layer.

When the nozzle plate is made of a metallic or plastic plate adhered to the substrate, the adhesion of the nozzle plate to the substrate is obtained at elevated temperature and under pressure. Generally, the substrate and the nozzle plate have different coefficients of thermal expansion, i.e. the materials in which the print head is formed (including the silicon based substrate, the polymeric layers and the nozzle plate) tend to contract and expand at different rates and of different amounts when they are cooled or heated; this is particularly important in case the nozzle plate is metallic. Thermal stresses are thus generated within the print head when it is cooled to room temperature, after assembly of the layers.

These stresses may warp the print head and cause fractures in the same. In addition, the fact that a plurality of different ink channels may be realized on the substrate weakens the substrate structure thereby increasing the probability of breakage if stresses are present.

Moreover, as the tendency in print heads fabrication is to increase the number of nozzles and channels within the same print head, also print head dimensions increase to accommodate on the same print all these structures, and thus the reduction of the stresses becomes of great importance because stresses also depends on the print head overall geometry.

It is known in the art to form strain relief elements on the print head (i.e. in one of the layers forming the same) in order to reduce these stresses induced in the structure.

In the European patent application No. EP 0925932 in the name of Lexmark International, Inc., a inkjet print head structure is disclosed, comprising a semiconductor substrate, a nozzle plate and a polymeric layer disposed there between. The polymeric layer contains expansion void spaces or valleys sufficient to inhibit stresses in the structure during the process of bonding the nozzle plate to the polymeric layer thereby reducing misalignment and warpage problems associated with conventional print head structures.

U.S. Pat. No. 5,988,786 in the name of Hewlett Packard Company relates to a print cartridge for an inkjet printer and more particularly to an articulate orifice membrane for a print head of a print head inkjet cartridge which improves the trajectory and placement of ink drops by providing reduced deformation of the orifices. In order to reduce the stress, an articulation is introduced into the inner surface of the orifice membrane. This articulation enables stress and strain to be concentrated at points away from the orifices, i.e. at regions bound by the ends of the articulations. In the preferred embodiment, the articulations are realized in form of serrations on the inside of the orifice membrane, such as laser ablated grooves.

In the U.S. Pat. No. 6,527,368 in the name of Hewlett-Packard Company, a fluid ejection device comprises a substrate having a first surface, and a fluid slot in the first surface is shown. The device further comprises a fluid ejector formed over the first surface of the substrate, and a chamber layer formed over the first surface. The chamber layer defines a chamber about the fluid ejector, wherein the fluid flows from the fluid slot towards the chamber to be ejected therefrom.

The U.S. Pat. No. 6,820,963 in the name of Hewlett Packard Development Company, L.P., discloses a fluid ejection head, which includes an orifice layer disposed on top of a substrate layer. The fluid ejection head includes a first group of fluid ejection orifices and a second group of fluid ejection orifices formed in the fluid ejection head, wherein the first group of fluid ejection orifices and the second group of fluid ejection orifices are configured to eject two different fluids, and an elongate channel formed in the fluid ejection head, wherein the channel is positioned between the first group of fluid ejection orifices and the second group of fluid ejection orifices in such a location as to inhibit cross-contamination of fluids ejected from the first group of fluid ejection orifices and second group of fluid ejection orifices.

Applicants have noted that the realization of long continuous channels in the orifice plate excessively weakens the overall structure of the nozzle plate or reduces its size, thereby causing problems during the manipulation of the nozzle plate during the print head assembling operation.

In U.S. Pat. Nos. 5,847,725 and 6360439, and in US patent application No. 2002/0041308 all in the name of Hewlett-Packard Company, a thermal ink jet printer head is disclosed, with an orifice layer for defining numerous of orifice apertures and numerous strain relief elements. Each strain relief element is a closed slit between abutting and separable portions of the plate, such that a stress applied to the plate across the strain relief element will tend to open the slit, or cause the edges to move in a direction perpendicular to the plane of the plate, or otherwise provide a thin cross section that deforms more easily, thereby limiting strain in other portion of the plate.

Applicants have noted that the slits which form the strain relief elements are substantially "one-dimensional", i.e. they extend substantially along one of the longitudinal axis of the metal orifice layer, whereas in the perpendicular direction (the other axis of the metal orifice plate) their thickness is substantially negligible. The slits thus are designed to deform only along a direction perpendicular to their longitudinal axis. In case of print head in which stresses are present also along the axis of the slits, this stress relief elements configuration may not reduce these stresses appropriately.

In the U.S. Pat. No. 6,799,831 in the name of Canon Kabushiki Kaisha, a liquid discharge recording head comprising a substrate on which an energy generated element for generating liquid discharging energy is provided, and an orifice plate which is laminated with the substrate and in which a discharge port corresponding to the generating energy element is provided, and wherein a liquid droplet is discharged in a direction substantially perpendicular to surfaces of the substrate and the orifice plate, and further wherein a flow path is formed between the substrate and the orifice plate, a groove encircling the flow path is formed in the orifice plate, and edge portions of the orifice plate contacted with the groove are formed as saw-shaped portions having a number of minute indentation.

Among the different embodiments described in this patent, in the seventeenth embodiment a number of through holes which encircle the ink flow path are provided on the orifice plate. The through-holes are cylindrical and are formed using a soluble resin layer: a number of small cylinder are formed and after the coat resin layer as the orifice layer is formed, pouring etching liquid from the discharge ports, the soluble resin is removed.

Applicants have observed that the through-holes in the nozzle plate expose a relatively large portion of the underlying substrate to the contact with the outer environment. This is likely to cause corrosion phenomena, which are likely to damage the substrate itself.

In addition, Applicants have noted that the presence of a large number of circular holes results in a significant portion of the nozzle plate having only very thin integral connection elements (between adjacent holes) to connect the adjacent portion together, this causing an excessive weakening of the nozzle plate. Applicants have further noted that in case of such apertures, a large portion of the plate is removed, weakening the overall structure. Indeed, if these apertures having width and length with cross section of the same magnitude, such in case of cylindrical hole, apertures are formed on the free surface of the nozzle plate having a large area compared to their perimeter. These apertures having such a large area may lead to contamination of the ink by external contaminants.

SUMMARY OF THE INVENTION

The invention relates to an ink jet print head for a printing device. In particular the print head of the present application is designed to achieve an enhanced relief and reduction of the stresses which are present in the print head and which are due to the process of fabrication of the print head itself.

The print head of the invention is generally used in connection with an ink cartridge containing a fluid, such as ink, to be sprayed to a recording medium. The print head allows the ejections of droplets of ink from orifices in fluid connection with ink reservoir(s) located inside the cartridge.

The print head comprises a composite structure, including a substrate in which, in the preferred embodiments, one or more slots are realized, and a nozzle plate bonded to it. In the nozzle plate, a plurality of nozzles are formed, connected to the slot(s), so that one or more fluid channels are formed connecting each nozzle to the reservoir(s). The print head of the invention may comprise any number of slots, and thus its dimensions may vary depending on the number of slots and nozzles realized. Each slot realized on the substrate, being a through-hole, weakens the substrate itself, leading to possible breakage problems during print head fabrication, as it will be detailed in the following.

Preferably, the substrate is realized in a semiconductor material, such as a silicon based material, while the nozzle plate comprises a metal layer.

The semiconductor substrate includes all the required circuitry to cause the emission of ink droplets and is usually made on a silicon chip, doped and coated as required.

The nozzle plate is preferably substantially rectangular defining a (X,Y) plane with two main axes X and Y, along one of which the slots, which are oblong through-holes, extend. In the following, the Y axis is chosen as the axis parallel to the main axis of the slots (i.e. the slots extend along the Y axis). A third axis Z is also defined, being perpendicular to the (X,Y) plane. The length of the nozzle plate is defined as its dimension along the Y axis, while the width of the plate is defined as the dimension of the plate along the X direction. As said, the width and the length of the plate depends, among others, on the number of slots and nozzles realized. Preferably, the width and the length of the nozzle plate are comprised between 2 and 8 mm and between 6 and 30 mm, respectively. Additionally, the thickness of the nozzle plate is preferably comprised between 15 μm and 75 μm.

Each slot is preferably dedicated to spray a single type of fluid, such as a single ink color, through a plurality of nozzles connected to it. Therefore, in case of a head including more than one slot, two adjacent slots being separated by a septum of substrate forming material, different pluralities of nozzles are realized, each plurality associated to a single slot.

The print head also comprises firing elements in order to eject the fluid from the nozzles of the nozzle plate. These firing elements are preferably resistors which are activated by a circuitry receiving command signals from the printing device.

Although the preferred embodiments of the invention will be explained using the thermal inkjet process, the head of the invention may also use mechanical device to eject ink as well.

Passage of ink(s) between one slot to the other, or from nozzles associated to a slot to nozzles associated to a different slot, is in general to be avoided in order to avoid inks' mixing and printing problems. In the nozzle plate a free surface is defined, which is the surface from which the ink is ejected. The opposite surface to this free surface is the one facing the substrate.

Preferably, in the print head of the invention, the nozzle plate is attached to the substrate via a barrier layer having the function of adhesive and of barrier for the ink not to leak from one slot/nozzle to the other(s). Preferably, the barrier layer comprises a polymeric material. However, other adhesives and/or layers may be used for this purpose and are included in the present invention.

The process of bonding the nozzle plate to the underlying layers is typically realized applying heat and pressure to the layers. Because typically the nozzle plate and the substrate have different modulus of elasticity and coefficient of thermal expansion, the materials of the composite print head structure tend to expand and contract at a different rates and by different amount when heated and/or cooled. The uneven expansion and/or contraction of the components during the bonding process induce stresses, deformations and possible breakage of the layers forming the print head, in particular of the substrate. Normally, in the presence of a barrier layer, since the barrier layer is made of polymeric material, it has a lower Young's modulus and is much less fragile than the semiconductor substrate and the nozzle plate, the effects of the uneven expansion and/or contraction subsequent to thermal treatments mainly affect the nozzle plate and the substrate, and only very marginally the barrier layer.

It is to be noted that these stresses also depend on other factors. Indeed, the stresses in the print head structure due to the thermal expansion of the nozzle plate are substantially determined by the combined effects of the following factors: a) the thermal contraction coefficient of the material by which the nozzle plate is made (the thermal contraction coefficient of the substrate, largely made of silicon or silica, is practically negligible). Such coefficient is of the order of magnitude of about 10-5/° C. in case of metal—e.g. Ni—, and more than 3-5 times larger for polymeric materials; b) the elastic modulus of the material by which the nozzle plate is made, which is of the order of magnitude of about 105 N mm-2 in case of metal—e.g. Ni—, while is 50-100 times lower for polymeric materials; and c) the thickness of the nozzle plate, and its elastic modulus, in combination, determining the pulling force associated with a given amount of thermal contraction.

Applicants have found that, particularly with relatively large print heads, the stresses associated with the thermal expansion and contraction of the nozzle plate are not only of significance in a direction transversal to the ink feeding slots of the substrate, but also in a direction perpendicular to such ink feeding slots.

Furthermore, such stresses are particularly important in case of metallic nozzle plates, because they may cause frequent breakings of the substrate during the assembly process, especially during the wafers' dicing, thereby causing a reduction in the overall process yield.

The applicant has observed that stress relieving elements extending along the whole extension of the printhead, such that they substantially mechanically disconnect two portions of the nozzle plate, can be used to alleviate thermally induced stresses along the Y axis of the printhead (as above defined); however, in most practical cases, such kind of stress relieving elements cannot be used to relieve thermally induced stresses along the X axis of the printhead, because they would interfere with the ink delivery and ejecting system of the printhead itself.

According to the invention, however, the applicant has observed that stress relieving elements, in form of slits or strip-like elements, arranged in a row along the Y axis of the printhead can alleviate the thermal stresses along the X axis of the printhead provided that such slits are each oriented with components both along the Y and the X axes.

The applicant has also observed that slits oriented with components both along the Y and the X axes are effective to alleviate thermal stresses in both directions without exposing to the external environment a significant portion of the underlying elements of the printhead.

According to the invention, in order to decrease the internal stresses above described, a plurality of stress relief elements are formed on the nozzle plate. In particular, each stress relief element comprises a single slit or a plurality of slits realized on the nozzle plate. Each slit defines an aperture on the free surface of the nozzle plate having a given shape and contour, as described in detail below.

Preferably, the stress relief element is then reproduced, more preferably in an even distribution, a given number of times on the nozzle plate. The stress relief element may thus be identified with an "unit of slit(s)" which is "copied" several times on the nozzle plate.

It is to be understood that, in the same nozzle plate, different types of stress relief elements may be formed (i.e. stress relief elements having different shapes). Indeed, it is not necessary for all or some of these "units" to be identical; for example, in a single nozzle plate three types of units may be copied a given number of times.

Applicants have noted that long slits, i.e. the length of which is of the same order of magnitude as the length of the plate, weaken the plate excessively, and serious handling problem may arise. Additionally, such long slits may eventually cause an "opening up" of the nozzle plate in case of elevated stresses. As a matter of fact, such long slits leave a very small amount of solid material to connect two adjacent portions of the nozzle plate, which may not be sufficient to prevent deformation or rupture of the nozzle plate during its handling.

The stress relief elements of the present invention, therefore, have preferably a length which is smaller than the length of the plate. Preferably, the length of the stress relief elements is comprised between 1/10 and 1/20 of the length of the nozzle plate.

Applicants have noted that, in case the metal plate is formed, according to a preferred embodiment of the invention, through an electroforming process, holes may not be cylindrical, but their cross section taken along a plane perpendicular to the (X,Y) plane increases going from the free surface of the nozzle plate toward the substrate. Therefore, for a given aperture formed in the free surface of the nozzle, a much larger aperture is formed in the opposite surface, again weakening the overall structure.

Thus to an aperture having a relatively large area on the free surface of the nozzle plate such as a regular polygon or the like corresponds an aperture on the opposite side of the nozzle plate having an even larger area, which further weakens the nozzle plate and reduces the surface available for adhesion to the substrate, while providing relatively small projections along the X and Y axis.

The stress relief elements of the present invention thus include slits which define apertures on the free surface of the nozzle plate in which one dimension is dominant which respect of the other, i.e. their length is much longer than their width.

The stress relief elements of the invention thus define apertures on the nozzle plate having a relatively long perimeter with a relatively small area. With the term "width" it is to be intended the average width of the aperture on the nozzle plate defined by the stress relief element (as said, each stress relief element may comprise different slit(s) and with the term "length" the total length of the aperture on the nozzle plate defined by the stress relief element, which may also have a curved shape. The stress relief elements of the invention will be therefore called "strip-like" stress relief elements because of this predominance of one dimension with respect to the other in their cross section on the plane defined by the nozzle plate, "strip-like" meaning that for each stress relief element an aperture is formed on the free surface of the nozzle plate and this aperture has a width much smaller than its length (i.e. the ratio between width and length of a stress relief element is of the order of 1.5%-3%).

Preferably, the width of the apertures is comprised between 5 μm and 40 μm, more preferably between 10 μm and 20 μm. Additionally, the length of the apertures is preferably comprised between 100 μm and 2000 □m, more preferably between 700 μm and 1400 □m.

The stress relief elements are then aligned and spaced apart from each other in such a way that they extend along the Y direction, which is the direction in which also the slots extends. Preferably, the stress relief elements span most of the length of the nozzle plate.

The location and mutual arrangement of the stress relief elements is determined by various constrains present in the layout of the nozzle plate.

Preferably the distance between two apertures defined by two adjacent slits on the free surface of the nozzle plate is longer than two times the thickness of the nozzle plate itself. More preferably, this distance is comprised between 3 and 5 times the thickness of the nozzle plate. This is due to the fact that, as said, the electroforming method preferably used to obtain the nozzles and the slits on the nozzle plate realizes holes the surface of which on the free surface of the nozzle plate is smaller than the corresponding surface realized on the opposite surface of the nozzle plate. This enlargement is of the order of the thickness of the nozzle plate in all directions and thus two slits on the nozzle plate, which are less than twice the thickness of nozzle plate away from each other, merge on the opposite surface of the nozzle plate and this may cause for example ink leakage and poor adhesion. The same distance of above at least two nozzle plate thickness is preferably realized also between any slit and any nozzle realized in the nozzle plate, between any two nozzles as well as between any slit/nozzle and the boundaries of the nozzle plate itself.

Another possible method to realize the nozzles and stress relief elements in the nozzle plate is via a micro-punching technique, although for features of relatively small size (e.g., less than about 30 μm of diameter), the electroforming technique is generally preferred.

Additionally, in order to avoid ink discharge, slits are preferably not formed in regions of the nozzle plate corresponding to the ink slots.

Preferably, the stress relief elements are disposed in columns parallel to the Y axis and they are located in regions of the nozzle plate corresponding to the septa between adjacent nozzles. Additionally, stress relief elements may be located in the boundary regions of the nozzle plate which are defined as the region between the slots and the boundaries of the nozzle plate. This boundary regions comprises four substantially rectangular regions, two extending mainly along the Y axis and two extending mainly along the X axis.

Preferably, columns of stress relief elements are realized on the boundary regions extending mainly along the Y axis, even if stress relief elements may also be formed in the other boundary regions as well, for example they may encircle the slots completely.

According to a characteristic of the invention, the stress relief elements have a "non-negligible" component both along the X axis and along the Y axis.

Indeed, Applicants have noted that prior art print heads including slits which defines segment apertures disposed along the Y directions can be considered as "one-dimensional" from the stress relieving point of view. These stress relief elements are capable of reducing stresses in the (X,Y) plane along X direction, but tensions in the perpendicular Y direction remain. This is due to the fact that the sum of all projections along the X axis of the apertures defined by these linear slits is extremely small, therefore the stress relief elements can not substantially deform in the direction perpendicular to the measured projections, giving this substantially "one-dimensional" behavior.

In detail, the stress relief elements of the present invention are so shaped and disposed in the nozzle plate that the sum of the lengths of all projections along the X axis of all the apertures on the nozzle plate defined by all the slits realized on the nozzle plate, sum which will be called in the following "total X projection", has a value which is comprised between 10% and 55% of the overall width of the nozzle plate.

Preferably, the length of total X projection is comprised between the 15% and 45% of the overall nozzle plate width.

The total projection is preferably above 10%. The upper value is limited by the constraints which are given by the print head layout. As said, since certain regions of the plate are preferably avoided, such as the regions corresponding to the slots, and considering the enlargement due to the process of electro-formation, a distance of at least twice the nozzle plate thickness is preferably present between the different elements (nozzles, slits, boundaries of the plate), which are realized on the nozzle plate. In addition, slits are preferably not too closely packed one another or in an excessive number in order not to weaken the overall structure.

In addition, preferably the projection along the Y axis of a stress relief element overlaps the projection(s) along the same axis of its adjacent stress relief element(s).

Additionally, preferably the length total Y projection, calculated analogously to the total X projection, is comprised between 75%-95% of the overall length of the nozzle plate, more preferably between 80%-90%.

More in detail, the preferred total X projection length depends among other on the thickness of the nozzle plate considered. For relatively "thick" nozzle plates, i.e. having a thickness above 40 μm, the preferred range of the length of the total X projection is between 30-45% of the width of the nozzle plate, while in relatively "thin" plates, i.e. the thickness of which is smaller than 35 μm, the preferred range is between 15-25% of the total width of the nozzle plate 6.

This is due to the fact that "thin" nozzle plate are weaker and more fragile when they have to be handled, before the ink jet print head assembly, thus preferably less slits are realized on it than in a "thick" plate in order to weaken as less as possible the nozzle plate and, with equivalent other conditions, the stresses increase with the thickness of the nozzle plate, thereby requiring an increased stress relief.

In case of a two-slots print head, the print head according to the invention preferably comprises a single column of stress relief elements located in the region of the nozzle plate corresponding to the septum. According to an additional preferred embodiment, three columns of stress relief elements are present, one located in correspondence of the septum between the two slots, and a column of slits for each boundary region along the Y direction.

In case of a three-slots print head, according to a preferred embodiment of the invention, two columns of stress relief elements are realized, each column is realized in a corresponding septum between two adjacent slots. In general, in a n-slot print head, preferably n−1 columns of stress relief elements are present, each column being located in a septum between two adjacent slots.

Additionally, preferably the columns are disposed in the nozzle plate in such a way that the overall lay-out is substantially symmetric with respect to the Y axis of the nozzle plate and, more preferably, approximately symmetric also with respect to the X axis.

The distance between different columns of stress relief elements is preferably at least two times the nozzle plate thickness, more preferably larger than three times the thickness of the nozzle plate. Even more preferably, the distance between different columns is comprised between 3 and 5 times the nozzle plate thickness.

According to a preferred embodiment of the present invention, the stress relief elements include slits which pass through the entire thickness of the nozzle plate: they thus define an aperture both on the free surface of the nozzle layer and on the surface opposite to it. However, even if less preferred, also closed slits, i.e. slits having a depth smaller than the thickness of the nozzle plate, may be realized in the print head of the invention, thus defining a deep groove (an indentation) opposite to the free surface of the nozzle plate. Indeed, Applicants have tested and calculated the behavior of closed slits and found out that their effectiveness as stress relief elements is lower than through-slits.

According to a first embodiment of the present invention, each stress relief element includes a single slit which defines an aperture on the free surface of the nozzle plate having an S-shape. In particular, the S shape is formed by the connection of a first and a second arc of circumference (having a given width), the first arc connected with an end to an end of the second arc, and the first arc having the concavity facing on the opposite direction than the one faced by the second arc. Each arc may be equal to half circumference, longer or shorter than this.

Preferably, the S-shaped slits are disposed one on top of the other in columns in such a way that the centers of curvatures of the arcs all lies on the same line which is parallel to the Y direction.

Preferably, the projection along the Y axis of an S-shaped slit overlaps the projection of the preceding slit and of the successive slit belonging to the same column. More preferably, also the projection along the X axis of S-shaped slit overlaps the projection of the preceding slit and of the successive slit belonging to the same column.

The print head of the first preferred embodiment may include stress relief elements all equal one to the other, such as two column of S-shaped slits formed by arcs the length of which is shorter than half circumference. However, other configurations may be envisaged. For example, the print head may comprise columns of stress relief elements of different types.

In detail, in a two slots print head, a central column of S-shaped stress relief elements (as explained above) is located between the two slots. The forming arcs of the S are equal to half circumference. Instead of a single column of stress relief elements, two columns may be located within the septum. In addition, the print head may also comprise two lateral columns of S-shaped stress relief elements located in correspondence of the boundary regions of the nozzle plate extended along the Y direction (a column for each boundary region). The stress relief elements included in these lateral columns are also S-shaped, but the arcs forming each S-shaped slit of the column are shorter than half-circumference and their radius is smaller than the radius of curvature of the arcs forming the stress relief elements of the central column.

Analog configurations may be used in an n-slot print head, with one or more columns of stress relief elements disposed within the septum between two adjacent slots and additional columns may be present in the boundary regions.

According to a second embodiment of the present invention, the print head includes a nozzle plate having L-shaped stress relief elements. In detail, each stress relief element comprises two slits, each of which defines an aperture on the free surface of the nozzle plate which has the shape of an L. The L is formed by connecting perpendicularly two linear segments, a first shorter segment and a second longer segment. Two L-shaped slits are realized so that they face each other in such a way that the two shorter segments are parallel one to the other, as well as the two longer segments are parallel one to the other. The shorter and longer segments of each slit are inclined with respect to the X and Y axis. The column of stress relief elements is realized locating each L-shaped element one on top of the other and preferably in such a way that all longer segments result parallel to each others as well as the shorter ones. Additionally, also in this case the projection along the Y axis of a given stress relief element overlaps the projections along the same axis of the preceding and following stress relief elements of the same column.

According to a variant of this embodiment, the two segments are connected forming an angle different from 90° and they are not disposed in pair, but each stress relief element includes a single non-perpendicular L. These slits are then disposed substantially as the S-shaped slits (the projection along the Y axis of a first slit overlaps the projection(s) along the same axis of its adjacent slit(s)).

In a third embodiment of the present invention, the print head comprises stress relief elements each of which includes five slits. The first slit defines a circular aperture on the nozzle plate. The other four slits are disposed along the sides of a rhomb, the first slit being located at its center, however without touching each other (i.e. the rhomb has no vertexes).

The so-formed rhomboid stress relief elements are then evenly aligned one on top of the other to form one or more columns. The rhomboid stress relief elements of the columns are oriented so that the major axes of the rhombs of all stress relief elements all lie on the same line which is parallel to the Y direction.

Many other configurations of stress relief elements are however possible.

Applicants have shown that in a print head including the plurality of stress relief elements above described, stresses in the (X,Y) planes, in particular along both X and Y directions, are reduced with respect to the print head of the prior art, where the stress reduction is effective along only one axis; consequently also the print head warpage outside of (X,Y) plane is reduced.

BRIEF DESCRIPTION OF THE DRAWINGS

Further features and advantages of an ink jet print head according to the present invention will become more clear from the following detailed description thereof, given with reference to the accompanying drawings, where.

PREFERRED EMBODIMENTS OF THE INVENTION

Figure 1:
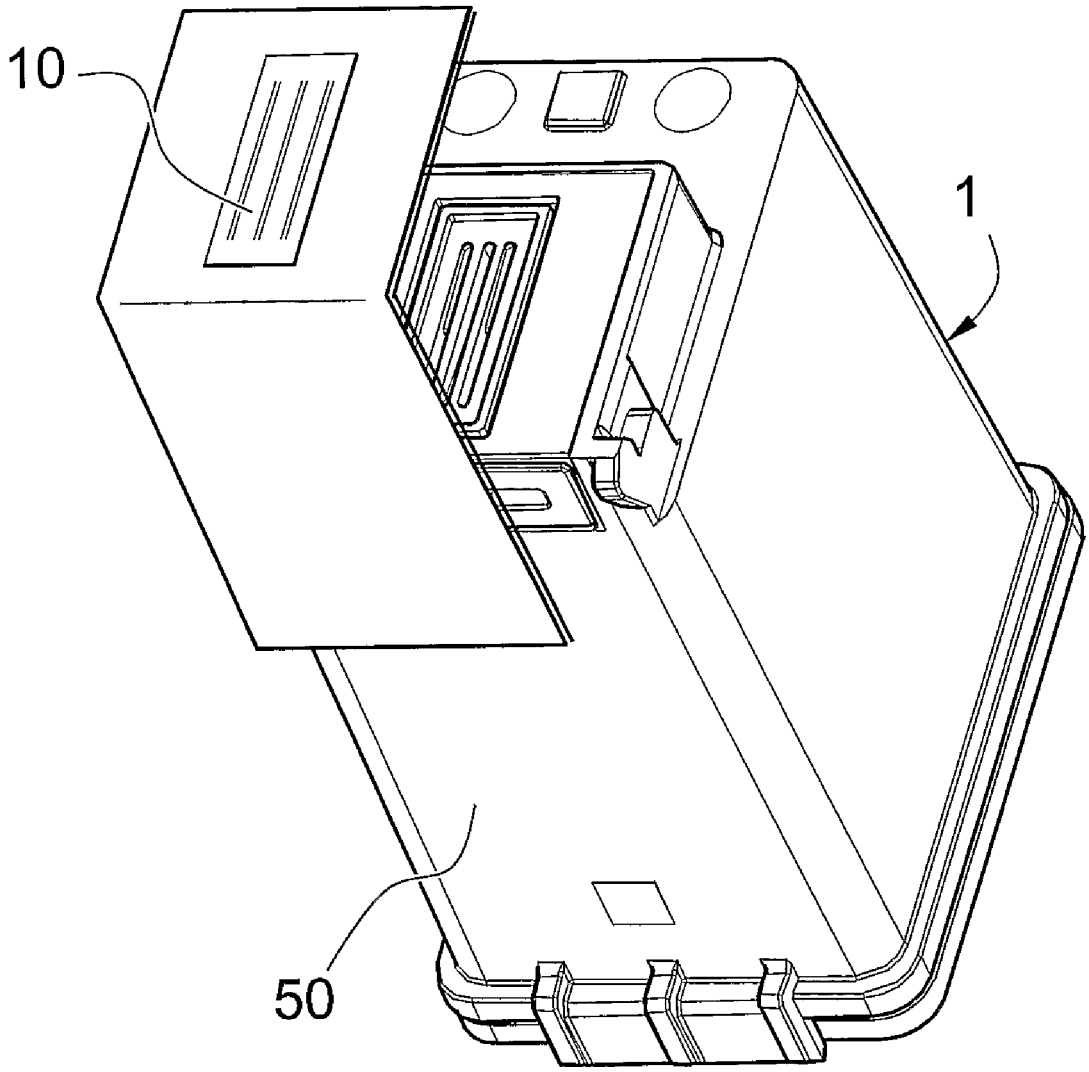
FIG. 1 is a schematic partially exploded perspective view of an ink cartridge containing an ink jet print head realized according to the invention.

With initial reference to FIG. 1, a partially disassembled ink jet cartridge 1 including a body member 50 and an ink jet print head structure, globally indicated with 10, is shown.

The ink jet cartridge 1 is configured to deposit a fluid, such as ink, onto a medium (not shown) positioned adjacent to the cartridge 1 via the ink jet print head 10.

The ink jet cartridge 1 may be used in connection to a printing device (not shown), such as a desktop printer, or in many other different applications. Other suitable printing devices in which the ink jet print head of the invention may be applied are facsimile machines, copier, etc, and they may have any desired size. Therefore in the following with the term "printing device" any of the aforementioned machines, or similar devices, is indicated.

An electronic circuitry is generally included in the printing device in order to control the movement of the cartridge 1 and the functioning of the ink jet print head 10, as described below.

The print head structure 10 comprises a substrate 2 (FIG. 2), in particular a semiconductor substrate, in which at least a slot 3, which defines a flow ink passage, is formed. Each slot 3, which passes entirely through the thickness of the substrate 2, connects to a corresponding ink reservoir (not shown) included in the body member 50 of the cartridge 1.

The substrate 2 is preferably realized in a silicon based material, such as crystal silicon, and preferably includes a plurality of layers stacked one on top of the other forming a silicon wafer. As an example, its coefficient of thermal expansion is of about 2.5-3 ppm/° C. in case of a silicon substrate. Preferably, the thickness of the substrate 2 is comprised between 0.5 mm and 0.8 mm.

Figure 2:
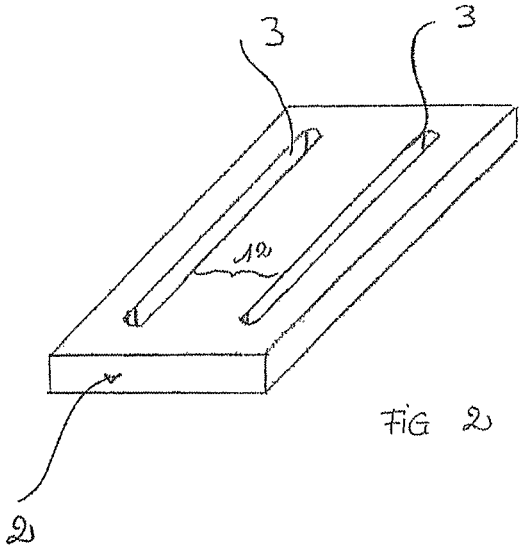
FIG. 2 is a schematic perspective view of an element of a print head according to the invention.

A simplified prospective view of the substrate 2 in which two slots 3 are realized is shown in FIG. 2.

The slots 3 are formed in the substrate 2 using any suitable technique, which includes, among others, abrasive sand blasting, wet etching, dry etching and laser machining or a combination of some of these techniques.

In addition, even if in the figures only ink jet print heads having two or three slots 3 are shown, the ink jet print heads realized according to the present invention may have any number of slots, generally one for each different fluid ejected. As an example, a color print head (as the one depicted in FIG. 10) comprises three slots, each slot connecting to a separated reservoir in the cartridge body 50 containing one of the three principal different colors cyan, magenta and yellow (or any other triplet of colors), however also a six colors print head may be envisaged which includes six or more slots. A black cartridge comprises on the other hand a print head 10 having only two slots. See for an example of a black print head, the one depicted in FIG. 11.

Figure 3:
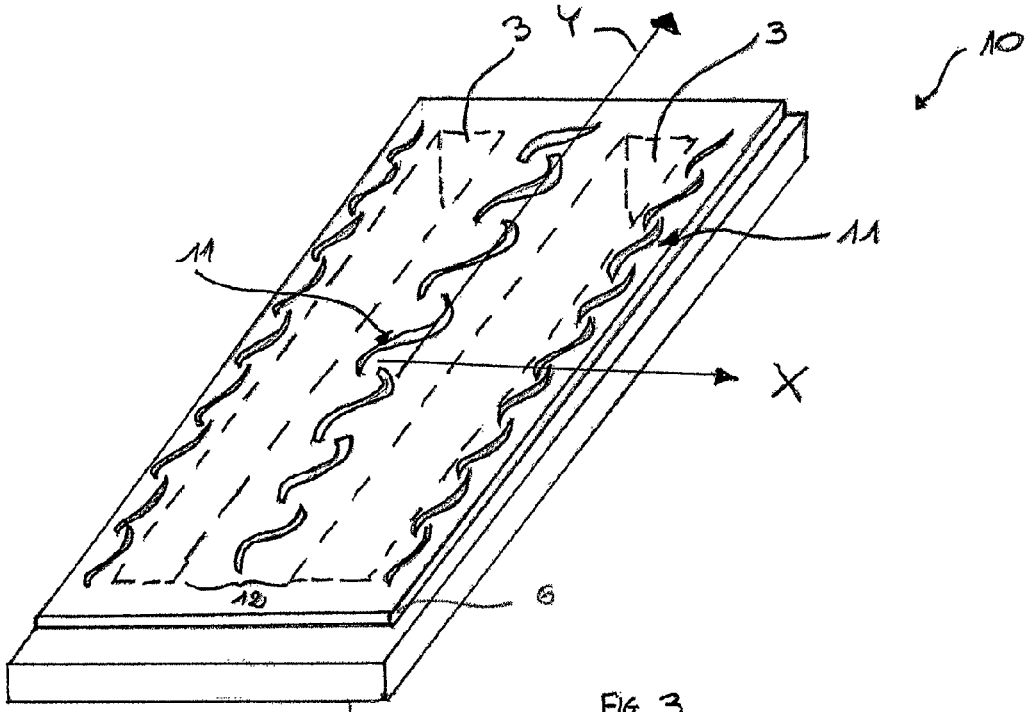
FIG. 3 is a simplified perspective view of a first embodiment of the print head of the present invention.

The slots 3 have an oblong shape and they extend substantially along a preferred direction Y which is also one of main axes X and Y of the substrate 2, generally rectangular. More preferably, the slots 3 extend along the axis of the substrate 2 which is parallel to the longer sides of the substrate 2. Additionally, the slots 3 are evenly spaced on the substrate 2 and a septum 12 separates each adjacent pair of slots 3 (FIG. 3, slots are depicted with a dashed line).

Figure 5:
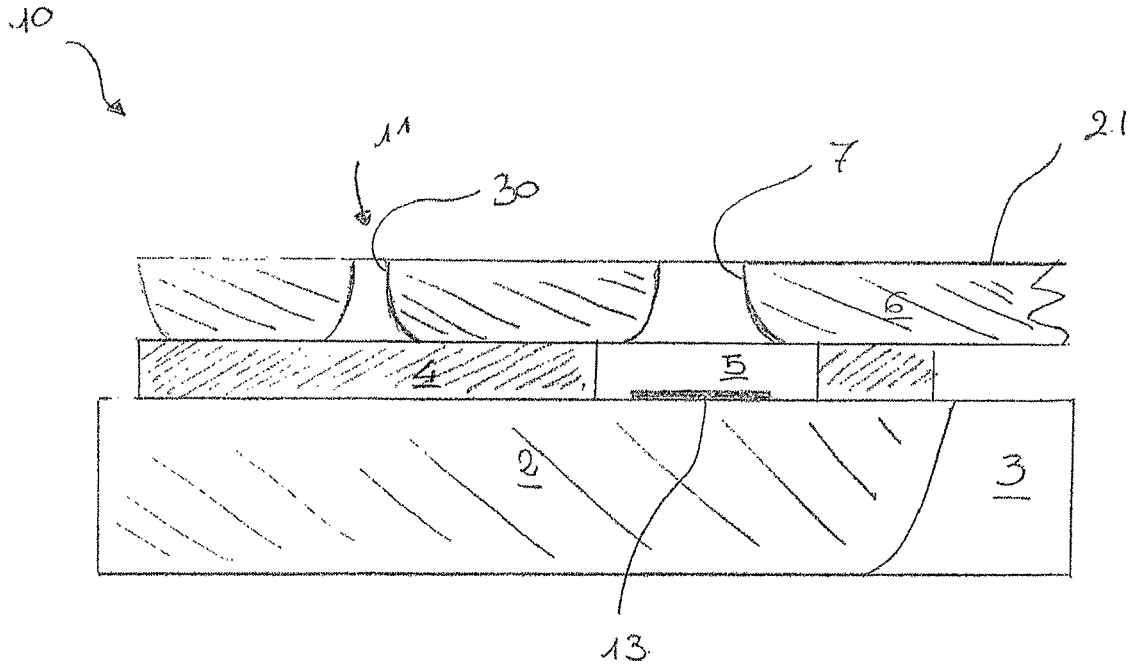
FIG. 5 is a partial cross sectional view of the print head of FIG. 3.

With reference to FIG. 5, on top of the substrate 2, a barrier layer 4 is formed, either deposited or attached to the wafer 2 using any suitable technique such as lamination, spin coating, spray coating, followed by a photolithographic process and development. The barrier layer 4 preferably comprises a polymeric material. This polymeric layer has advantageously an uniform thickness preferably comprised between 10 μm and 30 μm. The selected thickness depends on the print head 10 overall configuration and required characteristics. A preferred example of barrier layer 4 is the dry film resist Ordyl™ made by Tokyo Ohka Kogyo Co., LTD.

In the barrier layer 4, close to each slot 3, ink chambers 5 (see FIG. 5 which is a cross-sectional view of the print head 10) are formed, which are in flow communication with the slot 3. However any other location of the ink chambers 5 with respect to the slots 3 is possible and envisaged by the present invention.

Each ink chamber 5 contains a firing element 13 (schematically depicted in FIG. 5), such as a thin film resistor, in order to vaporize the ink therein contained. However not only thermal elements, but also mechanical devices may be used to eject the ink from the chambers 5 in the print head 10 of the invention. A signal coming from the circuitry (not shown) included in the printing device energizes the firing elements 13 when ejection of ink is requested.

Each chamber 5, or in proximity of it, may also contain additional devices, such as for example transistors for multiplexing the signal from the printing device.

A nozzle plate 6 is thus bonded to the barrier layer 4, as explained below. Preferably, the nozzle plate 6 includes a metallic material, preferred examples of which are nickel, copper, or a cobalt-nickel alloy. More preferably, the metallic nozzle plate 6 is plated with a noble metal, such as gold, palladium or rhodium. Alternatively to metal, the nozzle plate 6 may comprise a polymeric material.

The thickness of the nozzle plate 6 is preferably comprised between 15 μm and 75 μm and its coefficient of thermal expansion is of about 13 ppm/° C. in case of a gold plated nickel nozzle plate.

The nozzle plate 6 comprises a plurality of nozzles, all indicated with 7, which are aligned with the ink chambers 5, in order to provide a plurality of conduits from the ink reservoirs via slots 3 to a print medium (not shown) located outside the ink jet print head 10. The nozzles 7 have preferably a diameter of 10 micrometers to 50 micrometers and generally a density of spacing 1/75"-1/720". Through nozzles 7, ink is selectively expelled upon commands of the printing device, which commands are communicated to the print head 10 through the mentioned circuitry.

Even if all chambers are indicated with 5 and all nozzles with 7, it is to be understood that to each slot 3 corresponds a unique plurality of chambers 5, which are in fluid connection to only that selected slot 3, and each chamber 5 has its single corresponding nozzle 7.

Preferably, two separated columns 14, 15 of nozzles 7 are associated to each slot 3. However, it will be appreciated that each slot 3 may also have a single column of associated nozzles, or more than two columns of nozzles. Preferably, the nozzle columns 14,15 follow the two longer opposite sides of the slots 3 extending along the Y direction, substantially parallel to the axis of the slot itself. The two columns of nozzles are offset from each other so that a print may be realized having an higher DPI than the one achieved by the physical resolution of the nozzles.

The barrier layer 4 so sandwiched between the substrate 2 and the nozzle plate 6 has the function of an adhesive in order to connect the two mentioned layers, but also of a barrier to prevent leakage of ink from one ink slot 3 to the others which are generally very close together. Indeed, preferably the distance between two adjacent slots 3 is comprised between 0.8 mm and 1.6 mm and thus the nozzles 7 relative to a first slot 3 are very close to the nozzles relative to a second slot and cross-contamination may occur if any barrier is present.

Preferably, the nozzle plate 6 has a width comprised between 2 mm and 8 mm and a length comprised between 6 mm and 30 mm along the X and Y directions, respectively.

The process of bonding the nozzle plate 6 to the substrate 2, with the barrier layer 5 sandwiched therebetween, requires relatively high temperature and pressure, in order to achieve complete polymerization of the barrier layer 5, and thus obtaining the desired adhesion between the three layers. The coefficients of thermal expansion of the materials forming the three layers, as well as their moduli of elasticity, are different one form the others. At high temperatures, the barrier layer is a substantially plastic behavior and thus the substrate 2 and the nozzle plate 6 are allowed to perform different expansions and contractions according to their respective coefficients of thermal expansion. At the end of the polymerization, the wafer equilibrates at room temperature (i.e. around 20° C.), at which the barrier layer is much less plastic and thus the substrate and nozzle plate loose their freedom of expansions/contractions. Specifically, the nozzle plate tends to contract more than allowable and thus it remains longer (and larger) than it would at such a temperature if not bonded or adhered to other layers. This fact leads to tensile stresses of the nozzle plate 6, while the substrate 2, due to the nozzle plate contraction, tends to shrink more than it would at that specific temperature and thus undergoes a compressive stress.

These stresses that arise need to be compensated in order to avoid unwanted warpage, breakage or misalignment of the components forming the print head 10. The layer subjects to breakage is generally the substrate, more fragile than the metallic nozzle plate and weakened by the presence of the slots 3.

According to a main characteristic of the invention, a plurality of stress relief elements 11 is formed on the nozzle plate 6 is order to compensate for these stresses described above.

Each stress relief element 11 may comprise one or more slits.

Figure 6:
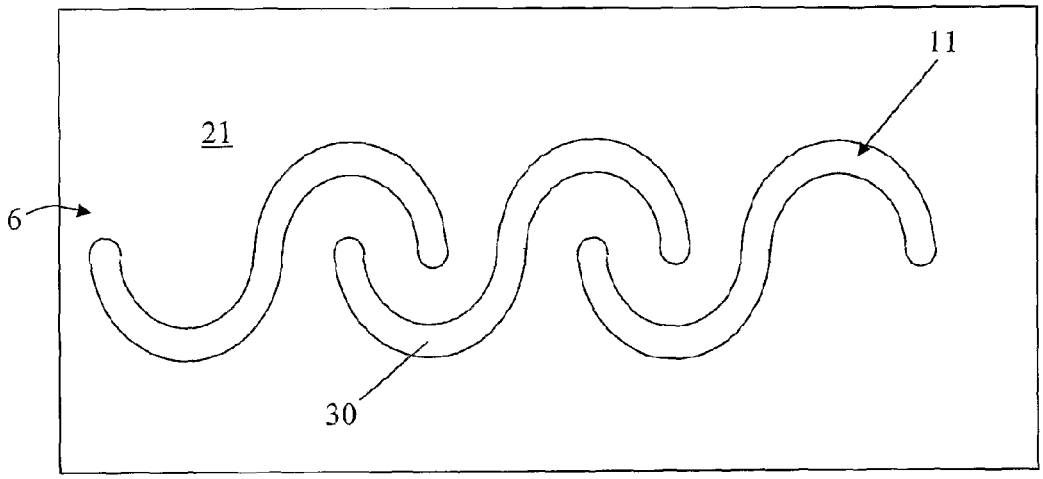
FIG. 6 is a schematic top view of a detail of an additional embodiment of the print head of the invention.
Figure 7:
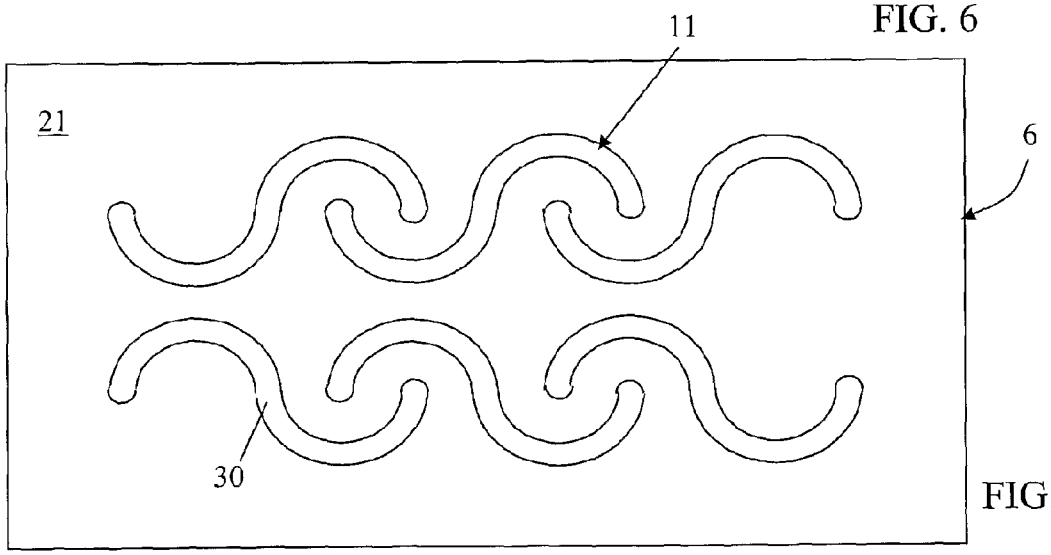
FIG. 7 is a schematic top view of a detail of an additional embodiment of the print head of the invention.
Figure 8:
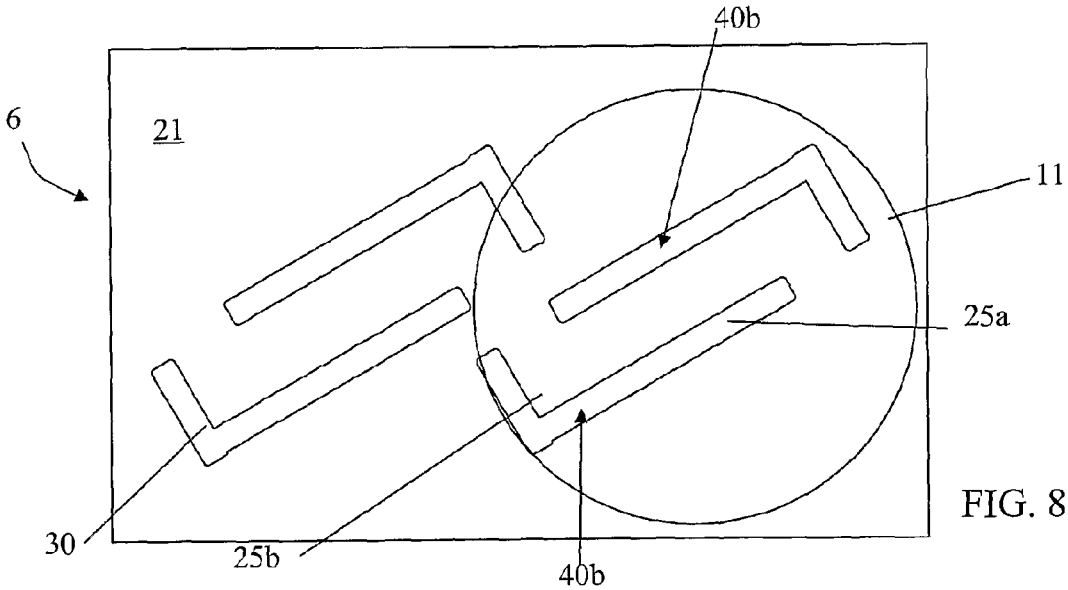
FIG. 8 is a schematic top view of a detail of an additional embodiment of the print head of the invention.

Each slit defines an aperture 30 on the free surface 21 of the nozzle plate 6 having a given shape (FIGS. 6-8). Each stress relief element is then duplicated a given number of times on the nozzle plate 6. Thus the stress relief element 11 is the "unit" which is copied several times in order to realize a given stress relief elements lay-out.

The length of the aperture 30 on the free surface 21 defined by each stress relief element 11 is much longer than the corresponding width, and thus the stress relief elements of the invention are called "strip-like" stress relief elements. Preferably, the width of the apertures 30 defined by the stress relief elements is comprised between 5 μm and 40 μm, more preferably between 10 μm and 20 μm. Additionally, the length of the apertures 30 is comprised between 1/10 and 1/20 of the length of the nozzle plate.

Figure 4:
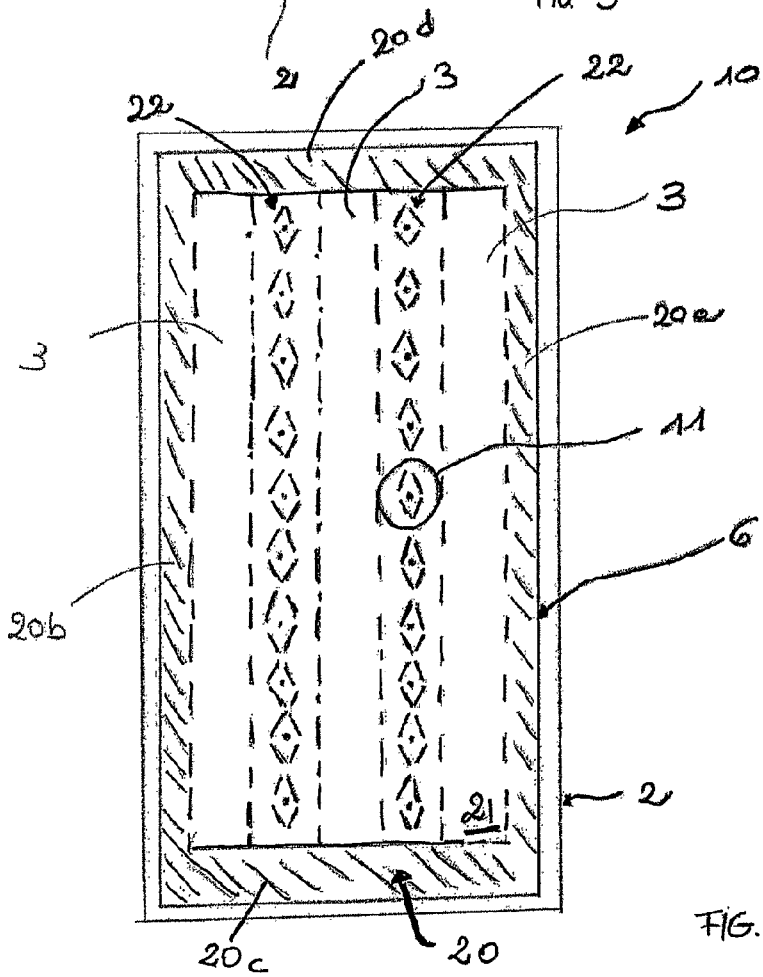
FIG. 4 is a simplified top plan view of a second embodiment of the print head of the present invention.

The stress relief elements 11 are preferably located between the slots 3, in particular they are positioned in regions corresponding to the solid septa 12 of the substrate. Additionally, the stress relief elements 11 may also be located in regions of the upper free surface 21 of the nozzle plate 6 between the slots 3 and the boundary of the plate 6 itself, called in the following "boundary regions" 20. In particular there are two boundary regions 20*a*, 20*b* substantially rectangular which extend mainly along the Y axis and two regions 20*c*, 20*d* which extend mainly along the X axis. These regions are depicted in FIG. 4 as a dashed area. Regardless of the specific shape, the boundary regions 20 are more generally the regions of the upper surface 21 of the nozzle plate 6 from its boundary up to the place in which slots 3 are realized on the substrate 2.

The stress relief elements 11 may be formed in any suitable location within the regions of the nozzle plate 6 corresponding to the septa 12 and boundary regions 20, however a symmetric configuration with respect to the Y axis is preferred, more preferably the configuration is symmetric also with respect of the X axis.

More in detail, the stress relief elements 11 are preferably disposed in columns 22, i.e. one on top of the other, and the columns 22 extend along the Y direction substantially parallel to the slots 3.

Each column 22 of stress relief elements 11 is preferably configured to extend along the Y axis at least as far as the length of columns 14,15 of nozzles 7. In some embodiments, it can be configured that it can extend beyond the ends of the aforementioned columns 14,15. The overall extension depends among others on the total area of the nozzle plate 6.

The stress relief elements 11 may have different shape, non limiting examples of which will be described in the following. This means that the lengths of both total projections of the plurality of stress relief elements 11 on the two main axes X and Y of the plate 6 have to be long enough. With the term "total projection" along the X axis (or Y), it is meant the sum of the lengths of the projections along the X (or Y) direction of all apertures 30 defined by each stress relief elements 11 present in a given print head 10. These projections may also overlap one with the others (i.e. the X projection of a given slit may overlap the projection(s) along the same axis of the adjacent slit(s)). Therefore, the X total projection is the sum of the projections of all apertures 30 on the X axis, while the Y total projection is the sum of the projections of all apertures 30 present in the nozzle plate 6 along the Y axis.

In order to calculate the total projections, the shape and dimensions of the apertures 30 as realized on the free surface 21 of the nozzle plate 6 are considered.

Figure 20:
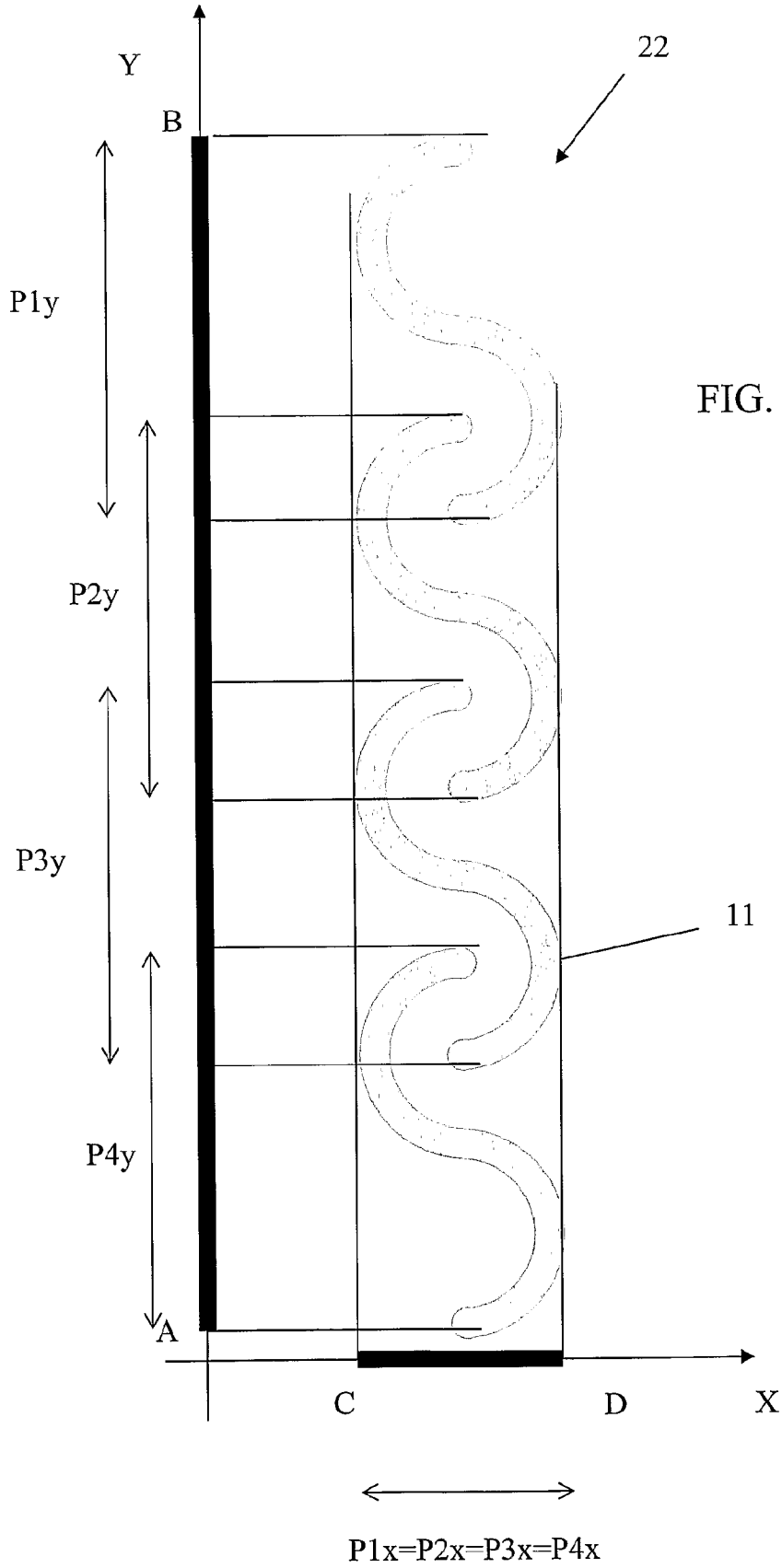
FIG. 20 is a schematic view of a detail of the print head of the present invention.

In FIG. 20, an example of calculation of the X and Y total projections is given. Assuming that the nozzle plate 6 contains only the four stress relief elements 11 depicted in the figure, the segments AB and CD drawn represents the Y total projection, formed summing up the lengths of the single projections P1*y*, P2*y*, P3*y* and P4*y*, and the X total projection of the stress relief elements 11 of the plate 6, respectively (also formed summing the lengths of the projections P1,*x* P2*x*, P3*x* and P4*x*, which, in this particular case, superimpose completely).

Applicants have found that to achieve stress compensation, the length of the total X projection of the stress relief elements 11 on the X axis has to be between 10% and 55% of the total width of the nozzle plate 6 in the same direction. Preferably, the length of the total X projection is comprised between the 15% and 45% of the total nozzle plate width.

The length of the total projection is above 10% of the total nozzle plate width in order to have a proper stress relief both along the X and the Y directions. The upper limit (55%) depends on the constrain which are given by the print head layout: certain regions of the plate 6 are preferably avoided, such as the regions corresponding to the slots 3 and in addition the stress relief elements 11 can not be too closely packed or in an excessive number not to weaken the overall structure, as will become more clearer also in the following.

More in detail, the preferred total projection length depends on the characteristics of the nozzle plate, in particular on its thickness. For "thick" nozzle layer, i.e. having a thickness s above 40 μm, the preferred range of the length of the total X projection is between 30-45% of the width of the nozzle plate, while in "thin" plates, i.e. the thickness of which is smaller than 35 μm, the preferred range is between 15-25% of the total width of the nozzle plate 6.

Additionally, preferably the length total Y projection, calculated analogously to the total X projection, is comprised between 75%-95% of the overall length of the nozzle plate, more preferably between 80%-90%.

Preferably, nozzles 6 and slits are realized using an electroforming process, which is a process for fabricating a metal part by electrodeposition in a plating bath over a base.

Figure 5A:
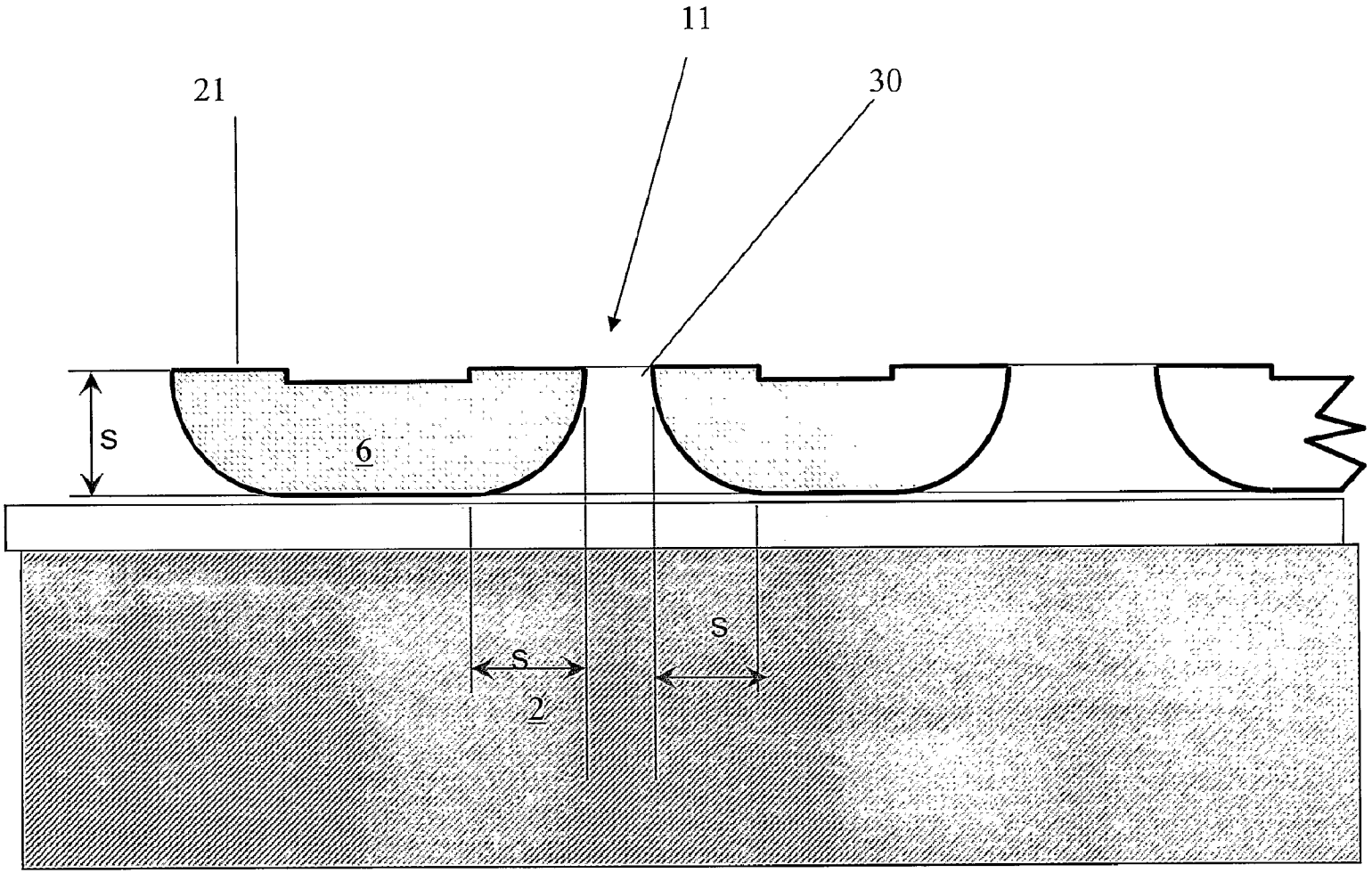
FIG. 5*a* is a detail of the cross sectional view of FIG. 5.

As shown in FIGS. 5 and 5*a*, which are cross sections of the nozzle plate 6 along a plane (Z,X) perpendicular to the nozzle plate 6, shapes realized with an electroforming process do not substantially exhibit a vertical profile along the Z direction. This means that, for example, holes realized on the plate 6 do not have a cylindrical shape when considered also along the Z direction. A cross-section along a plane perpendicular to the (X,Y) plane of a shape realized on the nozzle plate 6 with this technique presents a flared profile. This leads to the fact the size of the aperture 30 present on the free surface 21 of the nozzle plate 6 enlarges and the corresponding aperture 31 present on the opposite surface of the plate toward the barrier layer 4 has a wider size. The amount of enlargement depends on the thickness (called s in FIG. 5*a*) of the nozzle plate 6. In detail, if the shape realized on the plate 6, such as a stress relief element 11, is sectioned along a (X,Z) plane, the width of the shape itself, as shown in FIG. 5*a*, becomes wider of an amount equal to s in all direction. Therefore, when the stress relief elements are realized, this enlargement of the shape is to be taken into account, otherwise two different shapes may merge creating chambers which allow, for example, flow of ink, lack of bonding area, local deformation under pressure during bonding and unevenness of the free surface. Therefore, the number of stress relief elements 11 which can be formed on the plate 6 is also limited by the minimal distance between two different slits, between slits and slots, between slits and nozzles and so on, which in preferably in all cases longer than 2 s, where s is the thickness of the nozzle plate 6. Preferably the distance between any two shapes realized in the plate 6 is larger than 3 s, even more preferably is comprised between 3 s and 5 s.

According to a first embodiment of the present invention, each stress relief element 11 includes a single slit. The slit defines an S-shaped aperture 30 on the free surface 21 of the nozzle plate 6. The S-shaped aperture is given by two arcs 24*a*, 24*b* of circumference having concavity facing opposite directions, connected one to the other by a respective end of each arc 24*a*, 24*b*. Each arc may be smaller than, equal to or longer than half-circumference.

Figure 10:
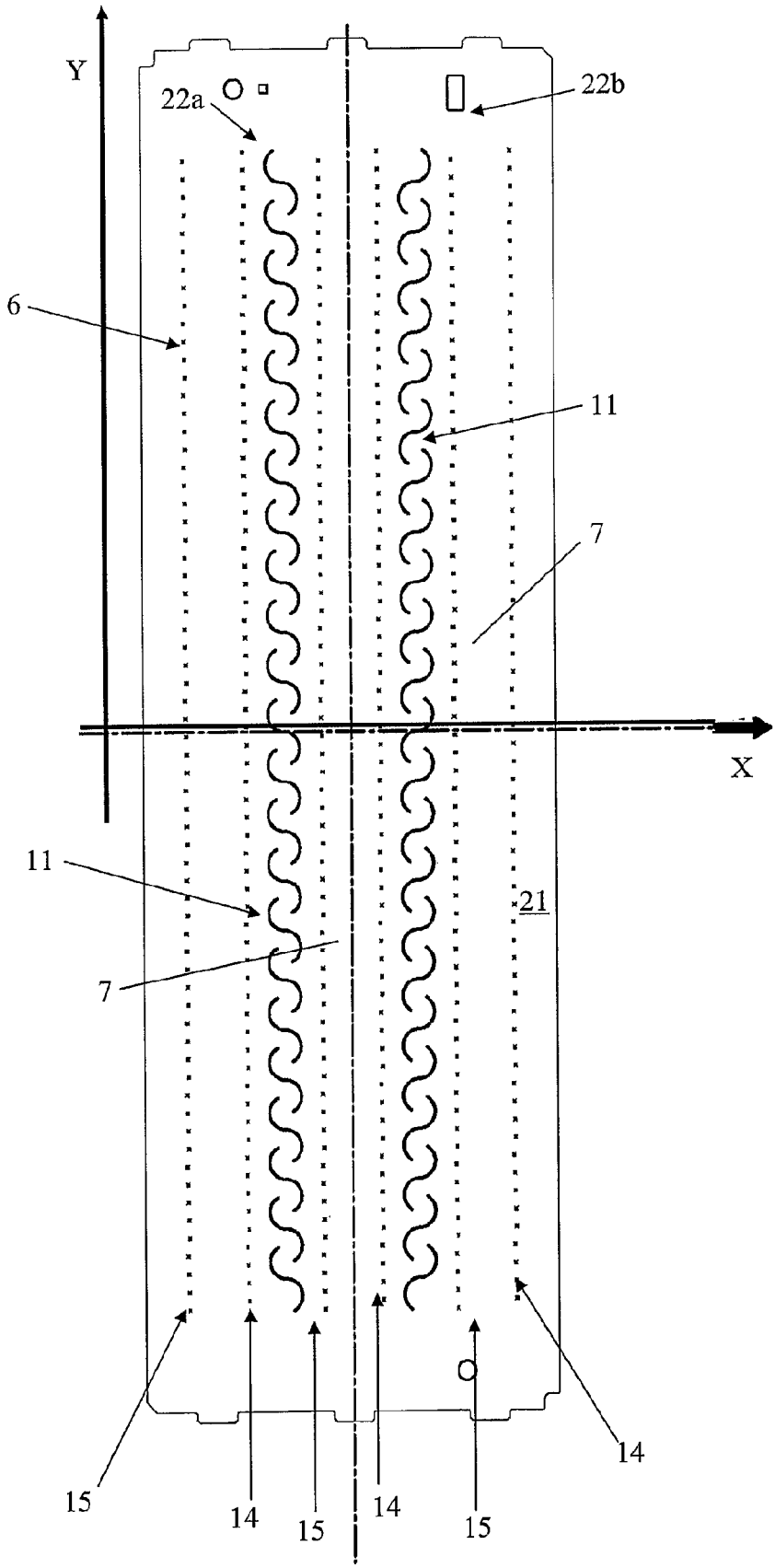
FIG. 10 is a top plan view of the print head according to an additional embodiment.
Figure 10A:
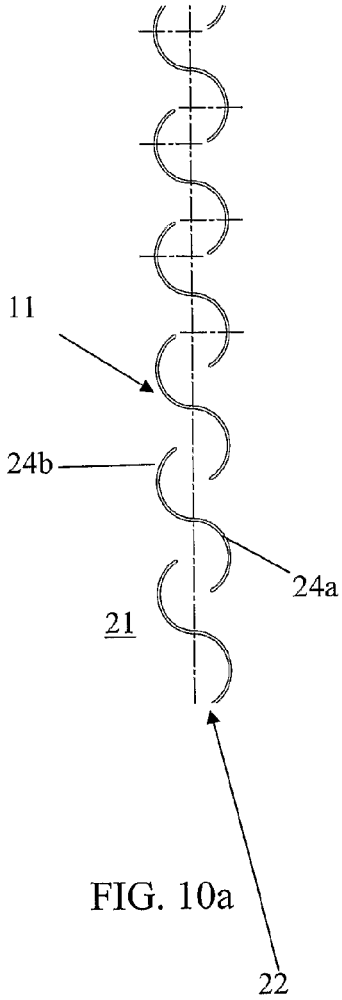
FIG. 10*a* is an enlarged detail of FIG. 10.

An enlarged view of such a S-shaped slit 11 is shown in FIG. 10*a*. The S-shaped slits 11 are thus disposed one on top of the other thus forming columns 22. In details, taking into account the centers of curvature of the two arcs 24*a*, 24*b* of each slit 11 forming a column 22, they are all aligned on a single line parallel to the Y axis and this is the case for all columns 22 on the same nozzle plate 6. Therefore, the overall projection along the X axis of the columns 22 is identical to the projection along the same axis of a single slit. Additionally, the arc 24*a* of a selected slit 11 of a column 22 faces for a given length the arc 24*b* of its adjacent slit 11 in the same column 22. Therefore, the projection of a slit along the Y direction overlaps the projection along the same axis of its adjacent slit(s).

The number of columns 22 of S-shaped slits formed on a nozzle plate 6 depends on the dimensions of the nozzle plate 6 and on the number of slots 3. Different layout are therefore possible.

A first possible layout is depicted in FIG. 10, where a three slots print head 10 is drawn. The print head 10 includes two columns of S-shaped stress relief elements, each column 22*a*, 22*b* being located within the septum 12 between two adjacent slots 3.

However, not only two columns of S-shaped slits may be present in the print head 10 of the present invention, as shown in FIG. 10, but also print head having additional columns or a single stress relief elements column 22 may be realized.

According to a different layout, the columns 22 of stress relief elements 11 may be closely packed together, i.e. the two (or more) columns 22 may be located at the closest possible distance (at least equal to 2 s), as depicted in FIG. 7. Preferably, the distance between the columns 22 is the same as the distance between two slits belonging to the same column. In this figure, only a portion of the columns 22 is depicted. Preferably in this embodiment of the invention the two columns are linearly offset one with respect to the other. In detail, taking a line parallel to the X axis at a given height along the Y axis, this line crosses an arc of a slit belonging to a first column and an arc of a slit belonging to the same column. The two arcs have opposite concavity.

Example 1

A three slots rectangular nozzle plate 6 is realized (see FIG. 10), having length equal to 12.840 mm along the Y axis, width equal to 4.160 mm along the X direction (see FIG. 10) and a thickness s of 30 μm. The plate 6 is realized in gold plated nickel and has 390 nozzles.

The plate 6 comprises for each slot 3 two columns 14, 15 of nozzles 7 disposed parallel to the Y axis of the plate. Between two adjacent slots 3, in the region corresponding to the septum 12, a column 22 of stress relief elements 11 is formed, for a total of two columns. No slits are formed in the boundary regions 20.

The two columns 22 of stress relief elements 11 are realized according to the first embodiment of the invention by electroforming method on the plate 6. Each slit 11 of the column 22 is formed by two arc 24*a*, 24*b*, each of which spans an angle of 150°. The radius of the arcs is equal to 0.165 mm and the width of the slit 11 is equal to 0.012 mm.

The length of each of the column 22, which are disposed symmetrically with respect to the Y axis is equal to 10.835 mm. The length of each column 22 is almost identical to the length of the columns of nozzle 14, 15 and/or of the slots 3.

Figure 15:
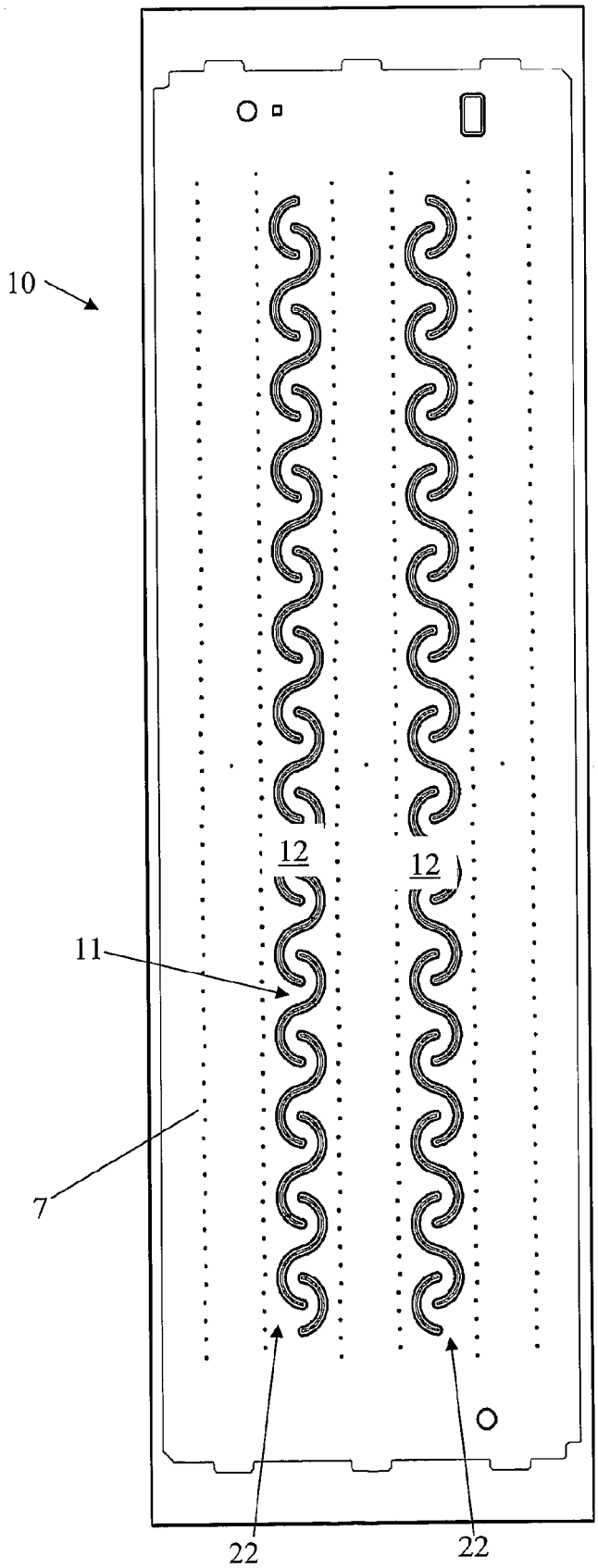
FIG. 15 is a top plan view of the print head of FIG. 10 showing the same additional details of FIG. 14.
Figure 16:
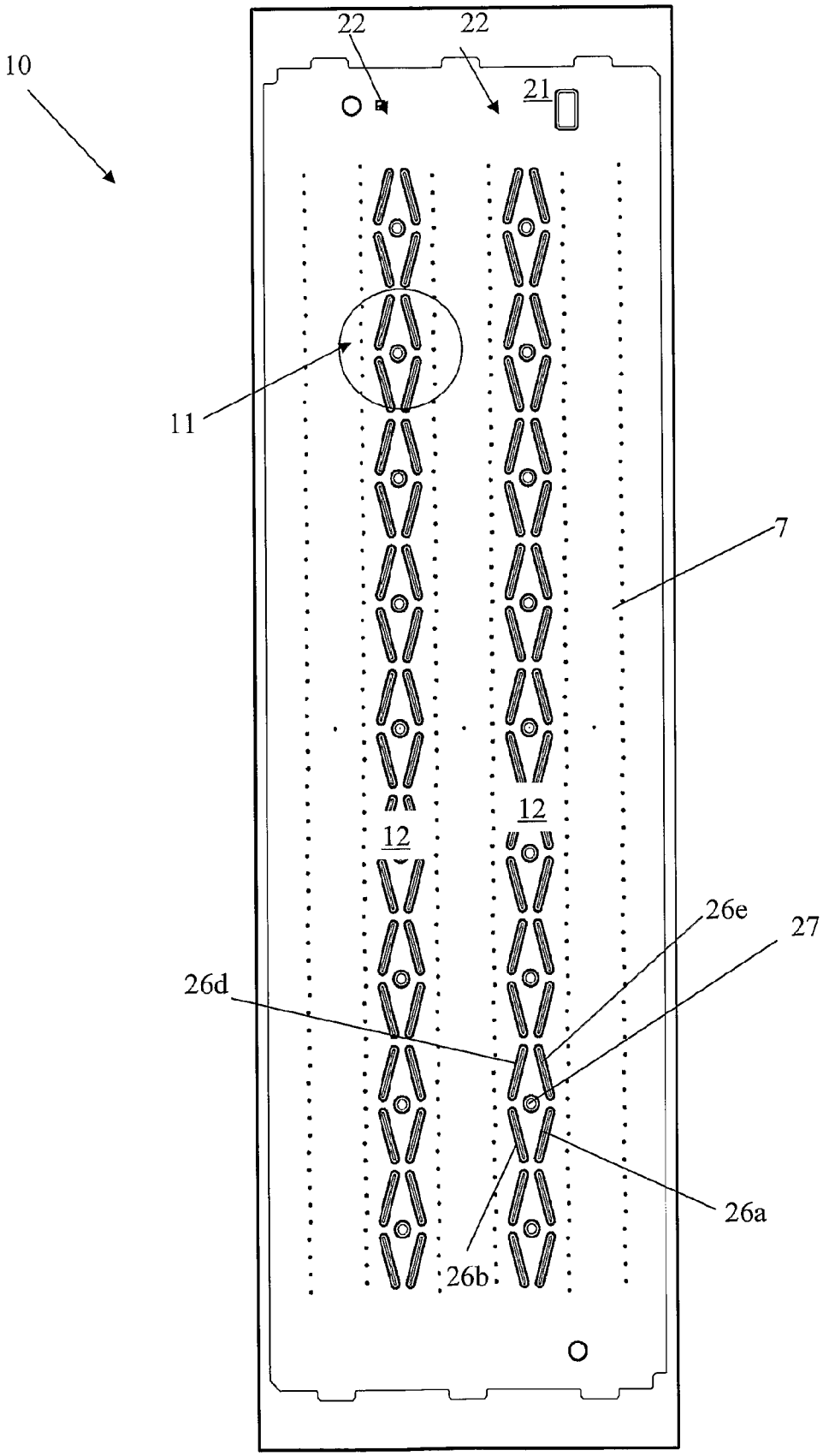
FIG. 16 is a top plan view of the print head of FIG. 4 showing the same additional details of FIG. 14.

In FIG. 15, it is shown the same nozzle plate of FIG. 10 with the addition of the contour plots of the apertures present in the surface of the nozzle plate 6 facing the barrier layer 4. As said, the apertures 31 corresponding to the apertures 30 of slits 11 on the free surface 21 of the nozzle plate 6 are wider and their contours is drawn in order to better show the difference and their real size.

The total Y projection of all columns 22 is substantially equal to the column's length. Regarding the X projection, the projection of the surface 30 defined by a single stress relief element 11 is equal to 7.9% of the total width of the nozzle plate, while the total X projection is equal to 15.8%.

On the surface of the nozzle plate facing the barrier layer 4 these percentages become equal to 9.4% for a single S-shaped slit and 18.8 is the total X projections.

Figure 11A:
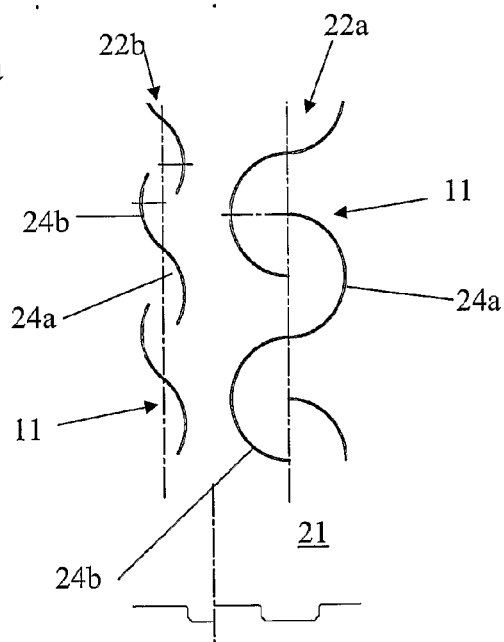
FIG. 11*a* is an enlarged detail of FIG. 11.
Figure 11:
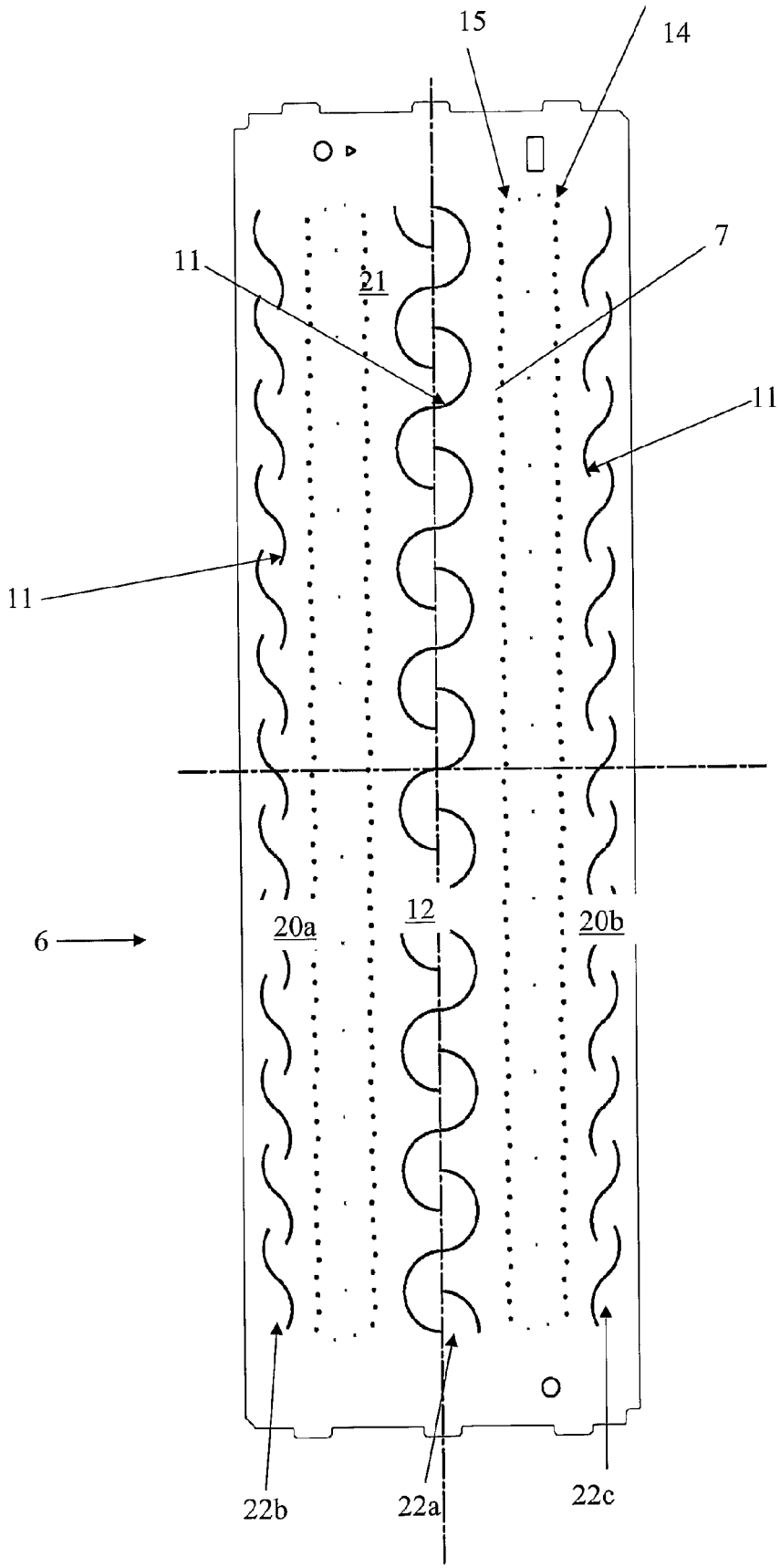
FIG. 11 is a top plan view of the print head of FIG. 3.

In FIGS. 3 and 11, a different layout of the stress relief elements is shown. In this print head 10, which comprises two slots 3, S-shaped stress relief elements 11 according to the first embodiment of the invention are disposed in three columns 22*a*, 22*b*, 22*c*: the first column 22*a* is located in the region corresponding to the septum 12 between the two slots 3 and the two symmetric lateral columns 22*b* and 22*c* are disposed in the boundary regions 20*a* and 20*b* extended along the Y direction of the nozzle plate 6. The stress relief elements 11 forming the central column 22*a* presents slits having and S-shape formed by two half-circumferences, while the two lateral columns 22*b* and 22*c* in the boundary regions 20*a*, 20*b* include slits 11 formed by two arcs of circumference having a length smaller than an half-circumference. A larger view of a detail of the stress relief elements 11 realized in this embodiment is shown in FIG. 11*a*.

Figure 12:
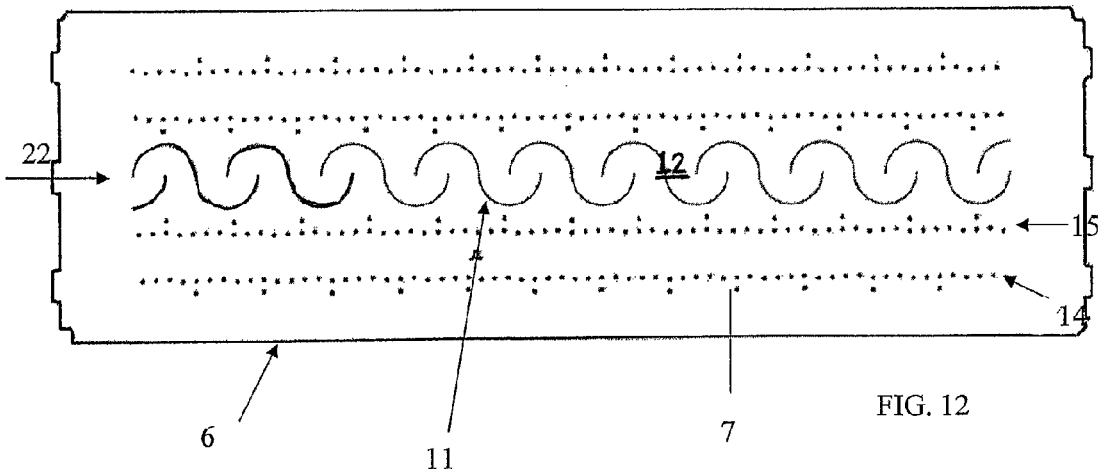
FIG. 12 is a top plan view of an additional embodiment of the print head.

In FIG. 12, an additional layout of a print head 10 of the present invention is shown. The print head includes two slots 3 (not shown in FIG. 12) and a single column 22 of S-shaped stress relief elements formed by half-circumferences located in the center of the septum 12 between the slots 3.

Figure 13:
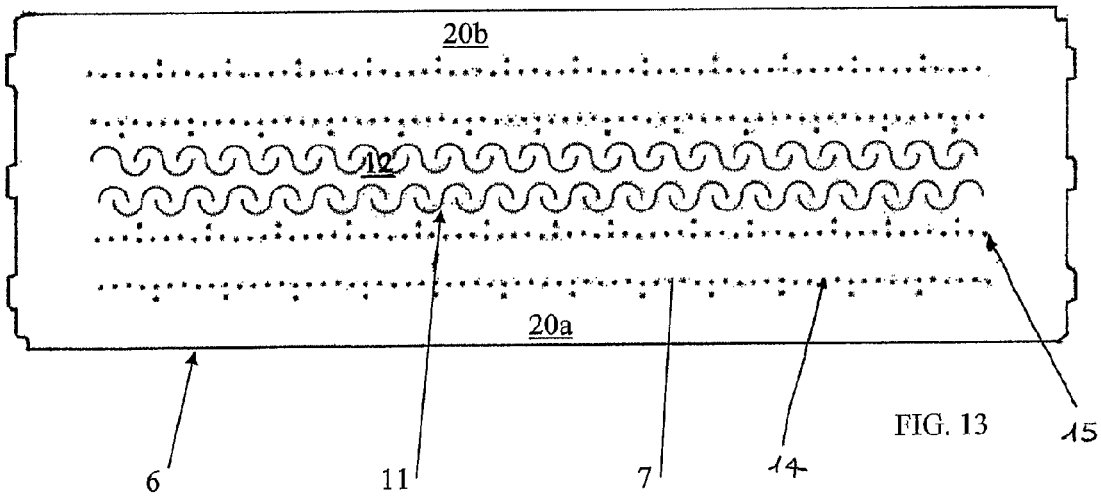
FIG. 13 is a top plan view of an additional embodiment of the print head of the invention.

In FIG. 13, a two slots print head 10 according to the invention includes two columns 22 of stress relief elements both located within the septum 12 between the slots 3. The two columns are located symmetrically with respect to the Y axis of the plate 6.

It is to be noted than, in each nozzle plate 6, different type of stress relief elements may be realized, having different shapes and dimensions.

Example 2

A nozzle plate 6 having the characteristics and sizes described in example 1, but including only two slots 3 instead of the three of example 1, is depicted in FIG. 11.

Three different columns 22*a*,22*b*,22*c* of stress relief elements are realized on the plate 6.

The radius of the half-circumferences forming the slits of the central column 22*a* is equal to 0.392 mm, while the radius of circumference from which the arcs forming the slits 11 of the lateral column 22*b*, 22*c* are taken is equal to 0.372 mm. Each arc of the slits 11 of the lateral columns 22*b*, 22*c* spans an angle of 150°. The width of the slit 11 of columns 22*a*, 22*b* and 22*c* is equal to 0.012 mm.

The length of each of the column 22*a*, 22*b*, 22*c* is equal to 10.835 mm along the Y axis. The columns are disposed symmetrically with respect to the Y and X axes.

The length of the total Y projection of this nozzle plate layout is substantially equal to the length of one of the columns 22*a,b,c* (which is the same for all columns).

The projection along X of a single column 22*a*, 22*b* or 22*c* is equal to: 17.4% of the total width of the plate 6 is the length of the X projection of the column 22*a* (equal to the length of the X projection of a single slit of the column 22*a*), while 7.2% of the total width of the plate 6 is the length of the X projection of each of the columns 22*b*, 22*c* (which is also equal to the X projection of a single slit belonging to column 22*b* or 22*c*). The length of the total X projection is thus equal to 31.8% of the width of the plate 6.

On the opposite surface facing the polymeric layer, 21.5% of the width of the plate is the length of the projection of a slit of the column 22*a*, and 9.6% is the length of the X projection of a slit of the lateral columns 22*b* and 22*c*. The total X projection in this opposite surface is thus equal to 40.7%.

A detail of a second embodiment of the print head of present invention is shown in FIG. 8, in which each of the stress relief elements 11 forming the columns 22 realized on a nozzle plate 6 (only a small portion of the column is shown in FIG. 8, but it is to be understood that the slits of this embodiment replace the slits depicted in the figures relative to the first embodiment of the invention and thus spans most of the length of the nozzle plate along the Y direction) include two slits, each of which defines an aperture 30 on the free surface 21 of the nozzle plate 6 which have an L shape. Each L-shaped slit 40*a*, 40*b* includes a first linear portion 25*a* and a second linear portion 25*b* connected perpendicularly to each other. An end of the first portion 25*a* is connected to an end of the second portion 25*b*. The pair of first and second slit, which forms the stress relief element, is formed facing two L-shaped slits in such a way that the first linear portion of the first slit parallel faces the first linear portion of the coupled second slit of the pair, and the second linear portion of the same first slit parallel faces the second linear portion of the second slit. Additionally, the first and second slit of the pair are oriented diagonally with respect of the X and Y axes, i.e. both first and second linear portions of each slit of the pair are not parallel either to the X nor to the Y axis.

The pair of slits 11 are then disposed one on top of the other in such a way that all first linear portions are parallel among them, as well as the second linear portions. Additionally, also in this case the projection of a stress relief element along the Y direction overlaps the projection along the same axis of its adjacent stress relief element(s).

As seen, each stress relief element of the column 22, in this embodiment, does not comprise a single slit as in the first embodiment, but a pair of slits.

Figure 17A:
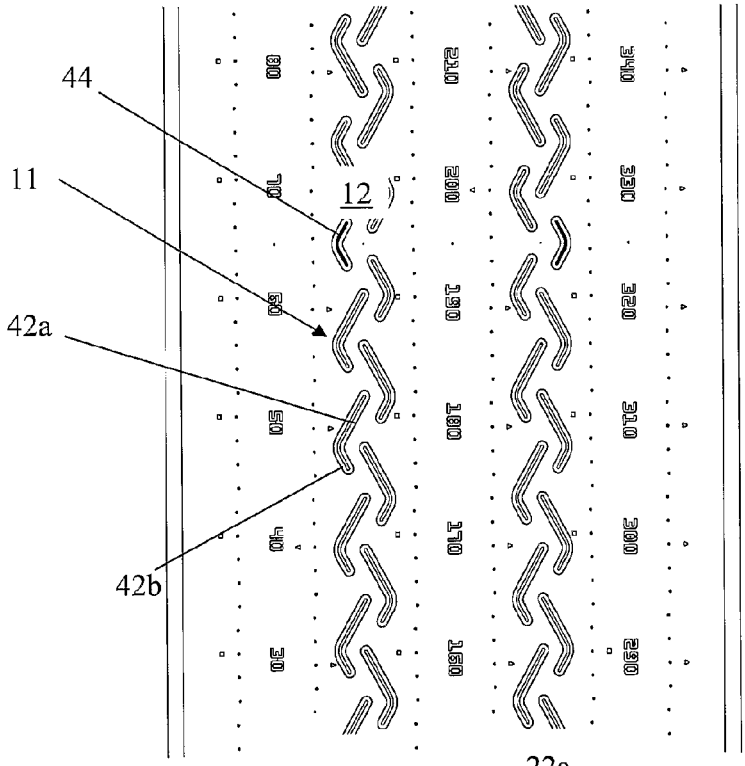
FIG. 17*a* is a top plan view of a detail of the print head of FIG. 17.
Figure 17:
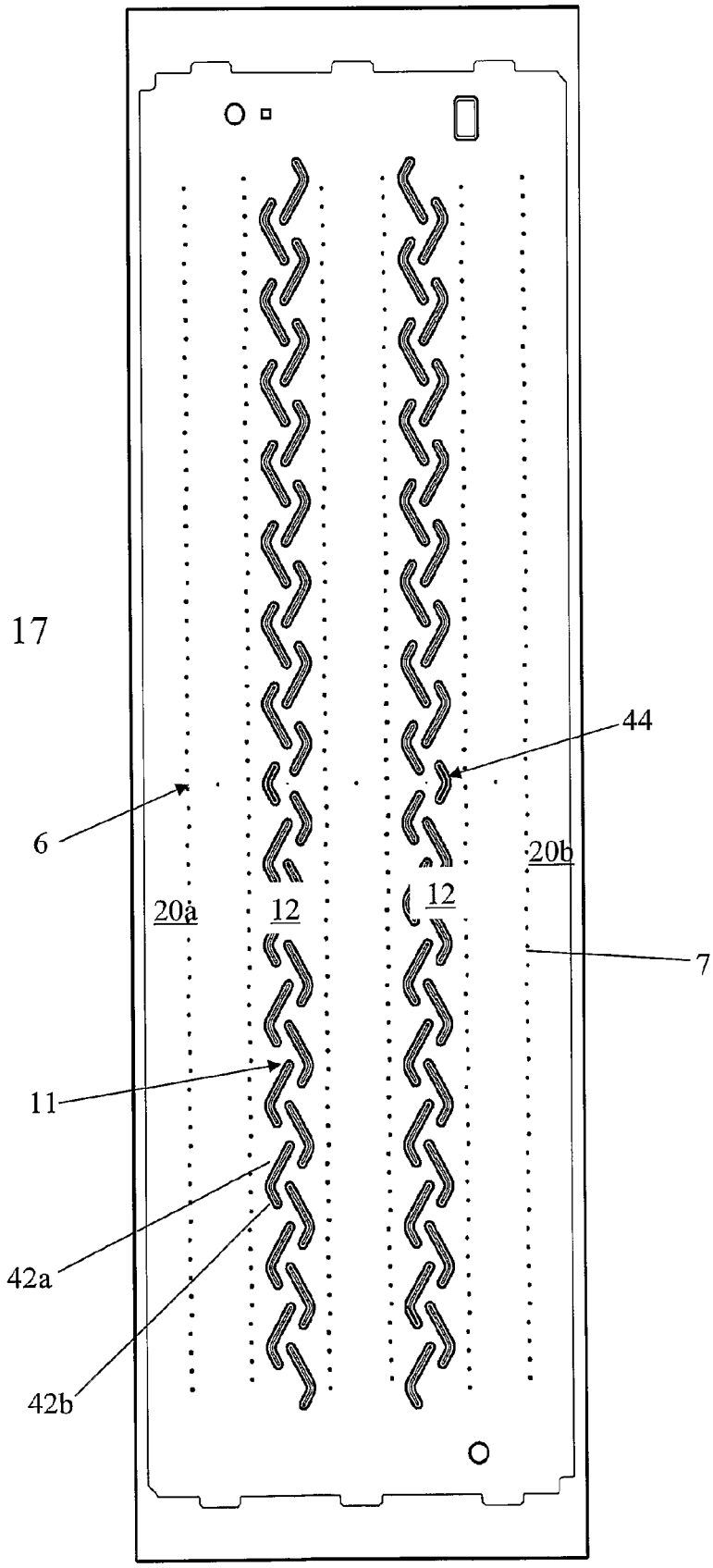
FIG. 17 is a top plan view of an additional embodiment of the print head of the invention showing the same additional details of FIG. 14.

A third embodiment of the print head of the invention is shown in FIG. 17 and it is substantially a variant of the second embodiment. In this print head, each stress relief element 11 include a single slit. Each slit defines and L-shaped aperture 30 on the free surface 21 of the nozzle plate, this L-shaped aperture including a first segment 42*a* and a second segment 42*b*. An end of the first segment 42*a* is connected to an end of the second segment 42*b*, but the two segments are not perpendicular one with respect to the other, but they form an obtuse angle.

The so formed non-perpendicular L-shaped slits are disposed in columns one on top of the other in such a way that a first slit having the concavity toward a given direction is followed by a slit the concavity of which is directed toward the opposite direction. In detail, the free end of the second segment 42*a* of a given slit faces the end of the first segment 42*a* of the following slit and so on, so that the Y projection of the first slit overlaps the Y projection of its adjacent slit(s).

In the example of FIG. 17, a detail of which is enlarged in FIG. 17*a*, the nozzle plate 6 includes two columns of non-perpendicular L-shaped slits, each of which is located in a septum 12 between two adjacent slots 3. Symmetry elements 44 may be present in each stress relief elements' column so that the overall layout is symmetric also with respect to the X axis.

In FIGS. 17 and 17*a*, not only the aperture 30 of each slit realized on the free surface 21 of the nozzle plate 6 is shown, but also the contour of the corresponding aperture 31 in the opposite surface.

Figure 4A:
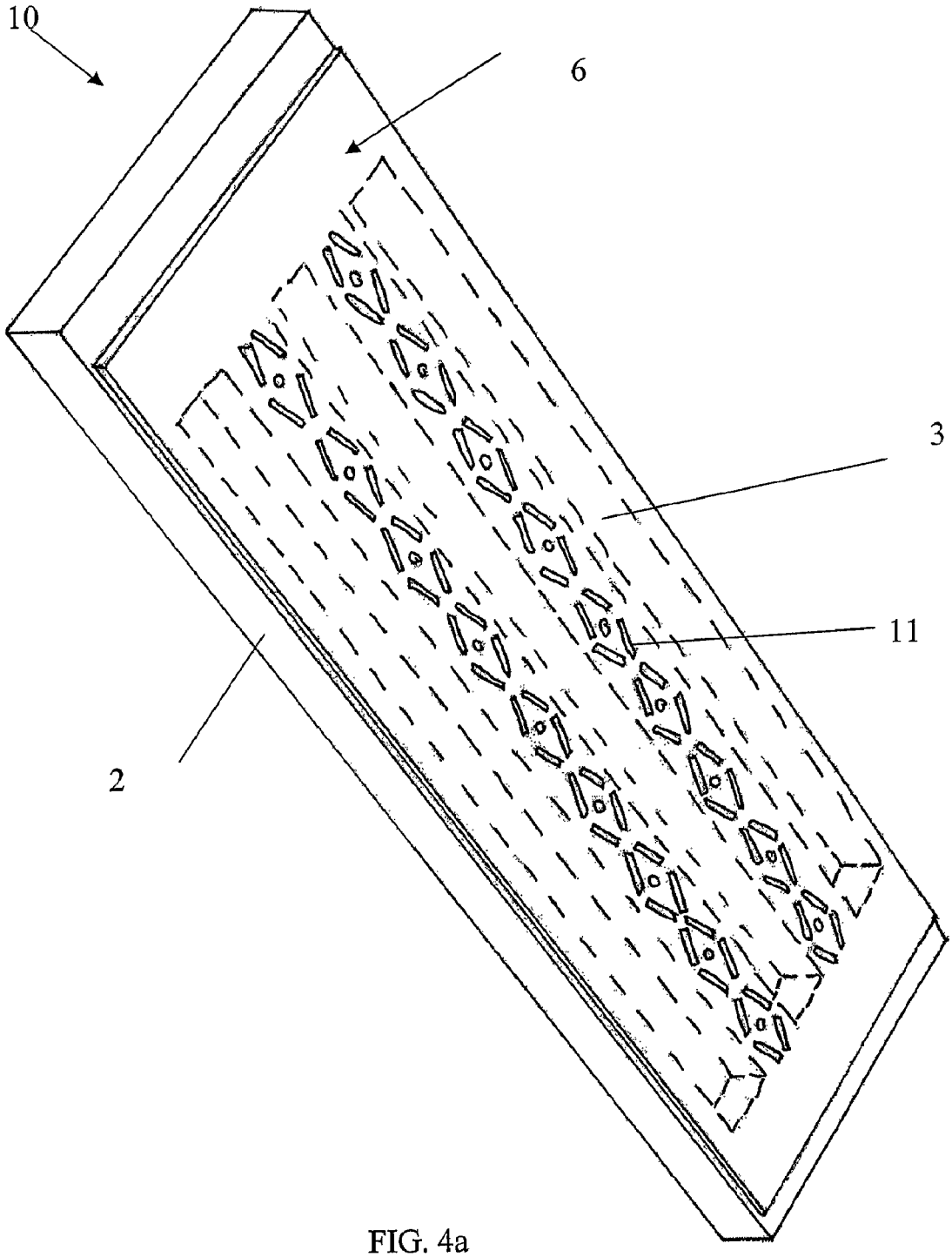
FIG. 4*a* is a simplified perspective view of a the print head of FIG. 4.

A forth embodiment of the print head structure 10 of the invention is shown in FIGS. 4 and 4*a*. In this embodiment, each stress relief element 11 of the column 22 is formed by five slits 26*a*,26*b*,26*d*,26*e* and 27, all separated from the others. In detail, the stress relief element of this embodiment of the invention comprises a small slit 27 which define a circular aperture on the free surface 21 of the nozzle plate having a diameter of 100 μm, surrounded by four slits the corresponding apertures of which have the shape of segments 26*a*,26*b*,26*d*,26*e* extending substantially along the sides of a rhomb, the circular slit 27 being located at its center, without the vertexes (i.e. the segments do not touch each other). The length of the aperture 30 on the free surface 21 defined by each segment 26*a*,26*b*,26*d*,26*e* is equal to 470 μm and the aperture width is equal to 20 μm. In other words, the structure of the stress relief element is the following: considering the layout of a rhomb, the four segment slits 26*a*,26*b*,26*d*,26*e* are located in correspondence of the sides of the rhomb without having contact among them. The distance between two segments is preferably of 140 μm. At the center of the rhomb, the circular slit 27 is realized.

The so-formed rhomboid stress relief elements 11 are then evenly aligned one on top of the other to form one or more columns. The rhomboid stress relief elements of the columns are oriented so that the major axes of the rhombs of all stress relief elements all lie on the same line which is parallel to the Y direction.

The different shapes above illustrated are given as an example, many other shapes are possible, as long as their shape is elongated in one direction (i.e. the length is longer than its width) and their total projections is included in the mentioned range. In addition, a single nozzle plate may include different columns of slits having different shapes.

Even if in the depicted embodiments all stress relief elements 11 pass through the entire thickness of the nozzle plate 6, which is the preferred embodiment of the invention, they also may extend through the plate 6 in the Z direction only partially. Additionally, the nozzle plate 6 may comprise both through-stress relief elements 11 and stress relief elements 11 which extend only partially, with respect to the plate thickness, along the Z direction. Preferably, typical depths of the slits 11 are equal to the preferred depths of the nozzle plate 6.

Applicants have performed several simulations in order to show the reduction of stresses obtained with the stress relief elements of the present invention. In particular, in a first set of simulations a comparison is made between four different print heads: a first and a second print head according to the first embodiment of the present invention, a first prior art print head without any stress relief elements, and a second prior art print head having the stress relief elements of FIG. 9 and described in detail below.

The four print heads considered have the same width and length, are formed in the same materials, have the same thickness (nozzle plate thickness=50 μm, the barrier layer thickness is equal to 20 μm and the Silicon wafer thickness=675 μm), the same number of slots (2, they are black and white print heads) and the same number of nozzles. The only difference between them lies on the shape and location of the stress relief elements.

Figure 18:
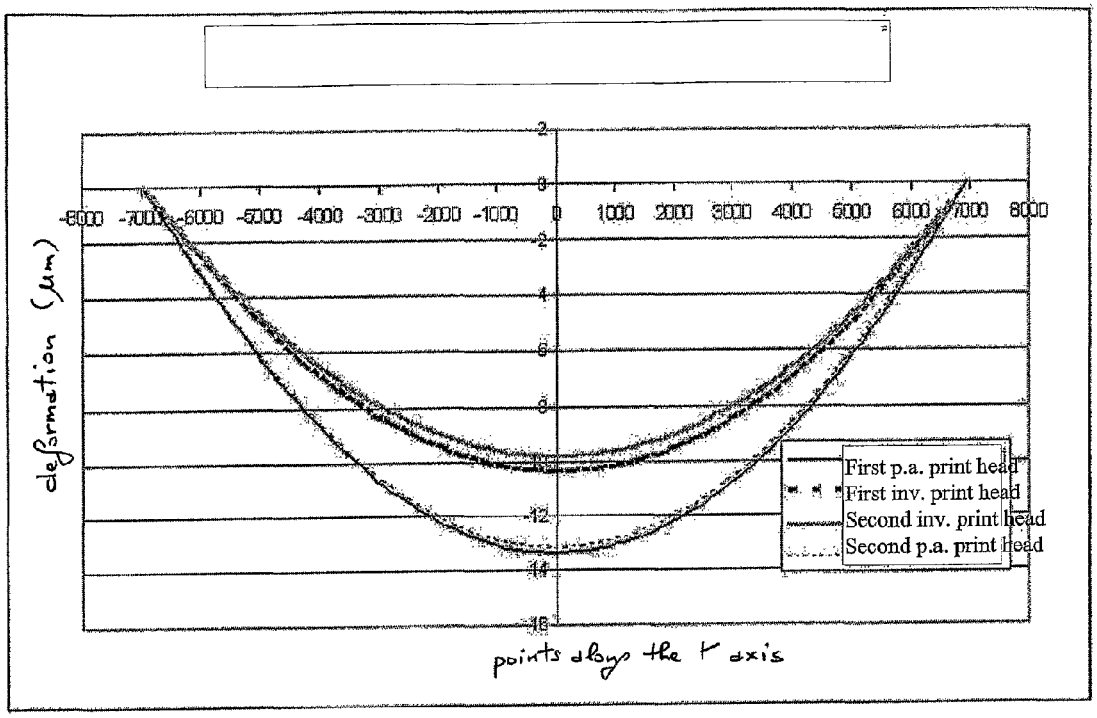
FIG. 18 is a graph showing the effects of stress on the prior art print heads and on the print heads of the present invention. The abscissas of the graph represent the location of points along the side parallel to Y of the nozzle plate of the print head, the ordinates represent the deformation in the Z direction due to stress.

A print head according to a first embodiment of the invention (in the graph of FIG. 18 it is indicated as First inv. Print head) comprises a single column 22 of stress relief elements realized according to the first embodiment of the present invention (i.e. each stress relief element comprises an S-shaped slit 11). The column 22 is located at the center of the septum 12 between the two slots 3 as depicted in FIG. 12.

A print head according to a second embodiment of the invention (in the graph of FIG. 18 it is indicated as Second inv. Print head) comprises two columns 22 of stress relief elements realized according to the first embodiment of the present invention. Both columns 22 are located within the septum between the two slots, symmetrically with respect to the Y axis, as depicted in FIG. 13.

A first prior art print head (in the graph of FIG. 18 it is indicated as first p.a. Print head) does not comprise stress relief elements.

Figure 14:
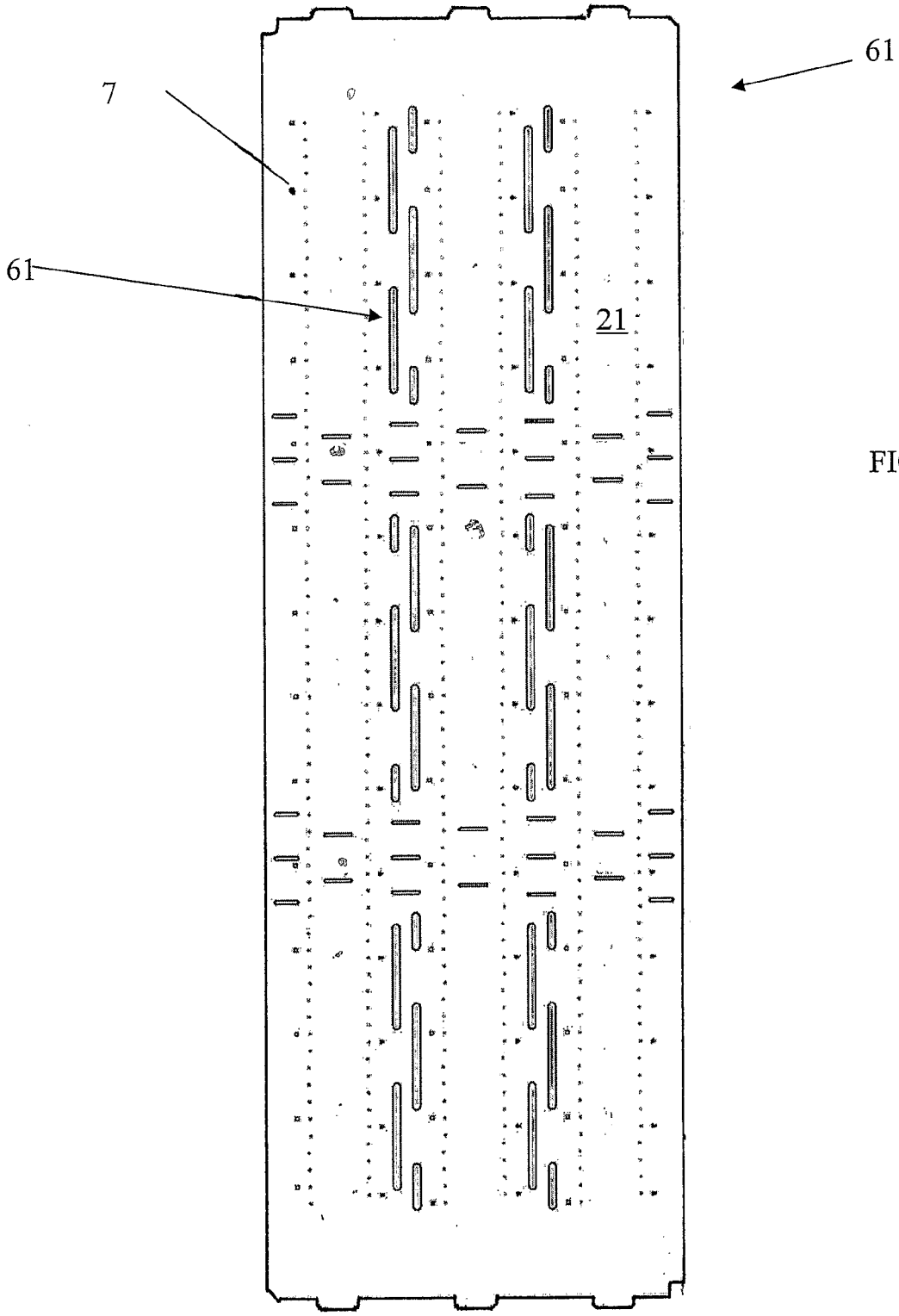
FIG. 14 is a top plan view of a prior art print head showing some additional details.

A second prior art print head structure 60 (in the graph of FIG. 18 it is indicated as second p.a. Print head) is similar to the one shown in FIG. 9 (the print head of FIG. 9 comprises three slots while the one here tested comprises only two slots, but the overall configuration is the same) and it comprises prior art stress relief elements 61, each of which includes a single slit having the shape of a linear segment parallel to the Y axis. The slits 11 are disposed in columns parallel to the Y axis in a close end to end relationship. It can be seen that the total projection of the stress relief elements along the X axis is outside the range indicated as suitable to decrease stresses also along the Y direction. Indeed the total projection along the X direction in this prior art head is equal to about 1.15% on the free surface 21 of the total width of the print head, while the total Y projection is substantially similar to the total Y projection of the print heads realized according to the present invention The slits 61 in this second prior art print head 60 are also realized using an electroforming process, and the increase of the aperture on the surface of the nozzle plate facing the barrier layer 4 with respect to the aperture realized in the free surface 21 is shown in FIG. 14.

In FIG. 18 a graph is depicted showing the deformations underwent by the four different print heads along the Z axis. The ordinates of the graph represent the deformation of the points of the Y axis of the nozzle plate. Given a point along the side of the nozzle plate parallel to the Y direction (abscissa of the graph), the corresponding ordinate represents its "deformation" along Z due to the stresses.

Different curves obtained for the different print head are drawn in FIG. 18: the continuous thin line curve represents the results for the prior art print head without stress relief elements which, as expected, shows the wider deformations. The thin dotted line curve represents the results obtained for the second prior art print head having linear slits: it is clear that the difference in deformations between this print head and the print head without any stress relief element is rather poor.

The thick dotted line and the waving line curves represent the results obtained for the first print head and the second print head according to the invention, respectively: it is clear that in these heads the deformations along Z, and thus the stresses, are reduced by a large amount.

A second set of simulations have been performed: three print heads have been compared, being of the materials of the set of heads considered in the previous set of simulation, but including three slots instead of two. The width and length of the layers forming the print head are also the same as in the previous example, whilst the thickness are the following: nozzle plate=30 μm, the barrier layer thickness is equal to 14 μm and the Silicon wafer=675 μm.

The first print head is a print head according to the first embodiment of the invention (named first inv. Print head in the graph of FIG. 19) having two columns of stress relief elements as depicted in FIG. 10.

Figure 9:
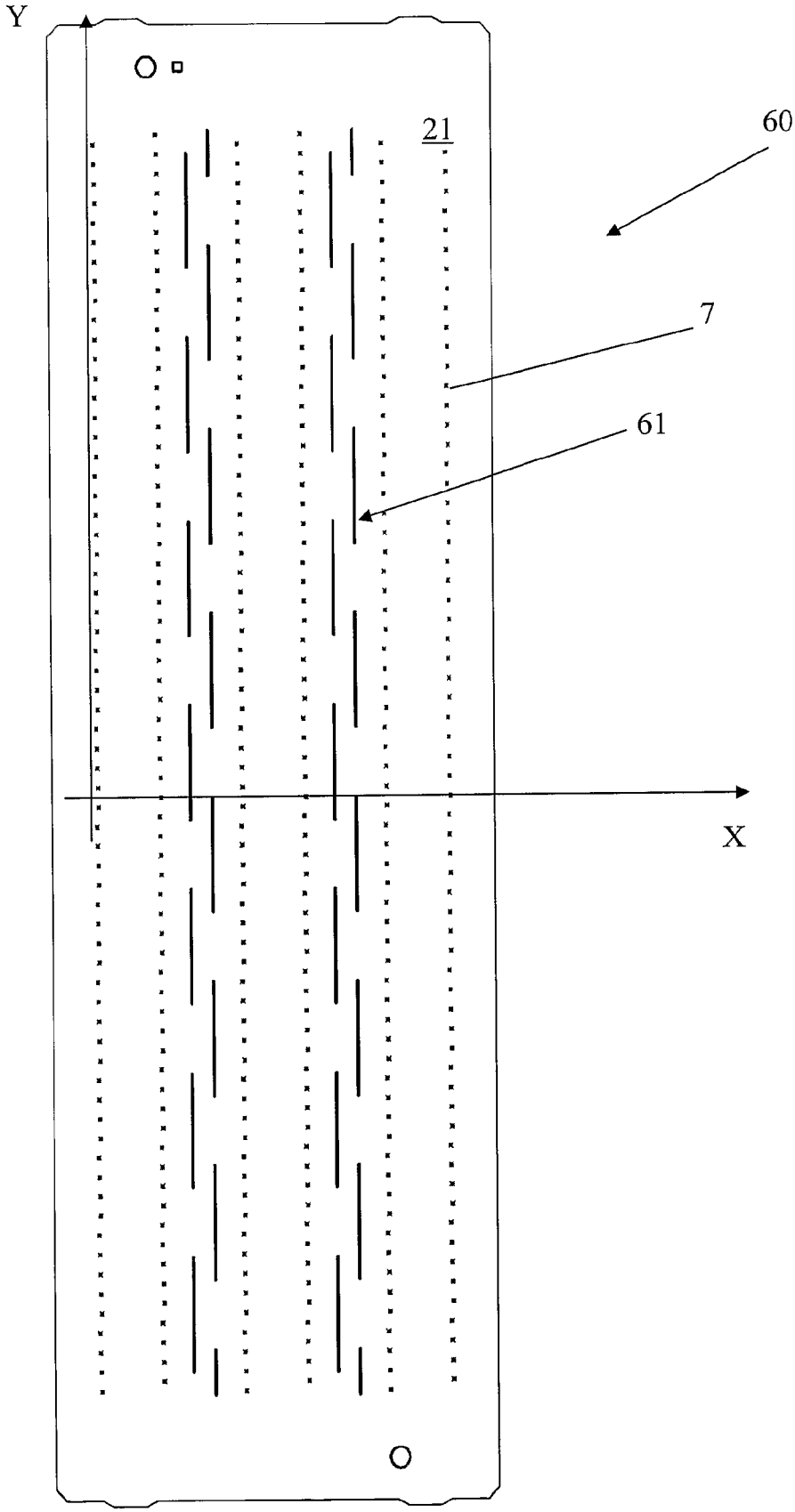
FIG. 9 is a top plan view of a print head according to the prior art.

The second print head is the prior art print head (called first p.a. print head in the graph of FIG. 19) without any stress relief elements, and the third print head (called second prior art print head in the graph of FIG. 19) is the print head with linear slits according to the prior art as depicted in FIG. 9.

Figure 19:
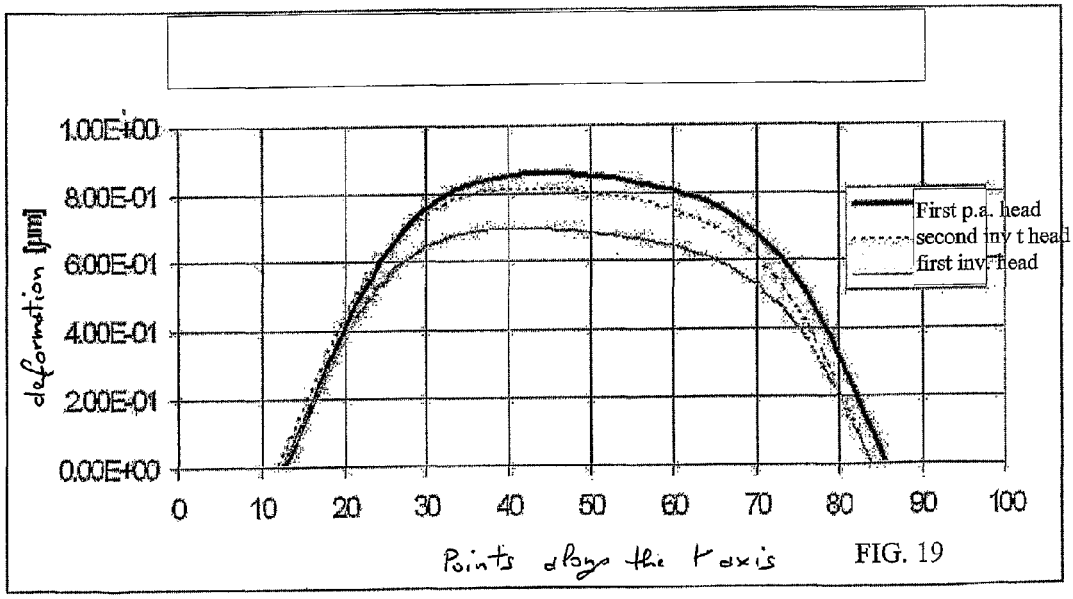
FIG. 19 is a graph showing the effect of stress on the prior art heads and on the heads of the present invention. The graph is analogous to FIG. 15, with the exception that shifts along the X axis are considered.

FIG. 19 is a graph showing the deformations along the X axis of the points located along the side of the nozzle plate parallel to the Y axis of this second set of simulations (three slots print heads). The thick continuous curve above all the others is the curve of the print head without any stress relief elements. It is clear from this graph that the stresses in this direction are reduced also using the linear slit of the prior art print head (the curve obtained for the print head having linear slits lies below the curve obtained for a print head having no stress relief elements, which means that defromations—and thus stresses—are reduced), however using the print heads of the present invention the stresses are further reduced, as it can be clearly seen from the depicted curve obtained for the print head of the first embodiment of the invention (thin continuous curve).

The invention claimed is:

1. An ink jet print head structure for printing devices, comprising:

a substrate in which one or more slots are located;

a nozzle plate connected to said substrate, said nozzle plate defining a first axis (X) and a second perpendicular axis (Y) and comprising a plurality of columns of nozzles extending along the second axis (Y) from which ink is ejected in fluid communication with said one or more slots, said one or more slots extending along said second axis (Y);

wherein a plurality of strip-like stress relief elements are located on said nozzle plate, said plurality of stress relief elements being disposed so to extend along the second axis (Y) at least between a pair of columns of nozzles or between a column of nozzles and a boundary of the substrate, each stress relief element of the plurality of stress relief elements defining an aperture on a free surface of said nozzle plate and having a width smaller than the length of said stress relief element, and wherein each of the stress relief elements defines a projection along the first axis (X), and the total projections defined by said plurality of stress relief elements along said first axis (X) have a value between 10% and 55% of the overall width of the nozzle plate along the same first axis (X).

2. An ink jet print head structure according to claim 1, wherein the total projection along said second axis (Y) has a length substantially equal to or longer than the length of said slot along the same second axis (Y).

3. An ink jet print head structure according to claim 1, wherein the total projection along said second axis (Y) has a resulting length comprised between 75% and 95% of the overall length of the nozzle plate along the same second axis (Y).

4. An ink jet print head structure according to claim 1, wherein said stress relief elements are aligned in columns parallel to said second axis (Y).

5. An ink jet print head structure according to claim 1, wherein said stress relief elements includes one or more slits, each slit forming said aperture on said free surface of said nozzle plate.

6. An ink jet print head structure according to claim 1, comprising more than one slot and wherein said stress relief elements are located in a region of said nozzle plate corresponding to the portion of substrate between two adjacent slots.

7. An ink jet print head structure according to claim 1, wherein said stress relief elements are located in a region of said nozzle plate between the boundaries of said nozzle plate and the portion of substrate in which said slot is formed.

8. An ink jet print head structure according to claim 1, wherein said nozzle plate has a given thickness and the distance between two separated stress relief elements is wider than two times said given thickness.

9. An ink jet print head structure according to claim 8, wherein said distance between two separated stress relief elements is between three and five times said given thickness.

10. An ink jet print head structure according to claim 1, wherein said nozzle plate has a given thickness and the distance between each of the stress relief elements and each of said nozzles is wider than two times said given thickness.

11. An ink jet print head structure according to claim 1, wherein said nozzle plate has a given thickness and the distance between any two nozzles is wider than to two times said given thickness.

12. An ink jet print head structure according to claim 1, wherein said total X projection has a resulting length comprised between 30% and 45% of the overall width of the nozzle plate along the same axis (X) when said nozzle plate is thicker than 40 μm.

13. An ink jet print head structure according to claim 1, wherein said total X projection has resulting length comprised between 15% and 25% of the overall width of the nozzle plate along the same axis (X) when the thickness of the nozzle plate is not larger than 35 μm.

14. An ink jet print head structure according to claim 1, wherein the width of said aperture defined by each stress relief element is between 5 μm and 40 μm.

15. An ink jet print head structure according to claim 1, wherein the length of said aperture defined by each stress relief element is between 100 μm and 2000 μm.

16. An ink jet print head structure according to claim 1, comprising a barrier layer sandwiched between said substrate and said nozzle plate.

17. An ink jet print head structure according to claim 16, wherein said barrier layer comprises polymeric material.

18. An ink jet print head structure according to claim 1, wherein said nozzle plate comprises a metal layer.

19. An ink jet print head structure according to claim 1, wherein said substrate comprises silicon based material.

20. An ink jet print head structure according to claim 1, wherein each of said stress relief elements comprises a slit which defines an S-shaped aperture on the free surface of said nozzle plate.

21. An ink jet print head structure according to claim 1, wherein the projection along said second axis (Y) of the aperture defined by a stress relief element overlaps the projection along the same axis (Y) of its adjacent stress relief element(s).

22. An ink jet print head structure according to claim 1, wherein each of said stress relief elements comprises a pair of first and second slits, each slit defining an L-shaped aperture on the free surface of said nozzle plate.

23. An ink jet print head structure according to claim 1, wherein each of said stress relief elements comprises a slit defining an L-shaped aperture on the free surface of said nozzle plate.

24. An ink jet print head structure according to claim 1, wherein each of said stress relief elements comprises a first, second, third, fourth and fifth slit, said fifth slit defining a circular aperture on the free surface of said nozzle plate and said first, second, third and fourth slit defining segment apertures on said free surface of said nozzle plate.

25. An ink jet print head structure according to claim 1, comprising n slots and n−1 columns of stress relief elements, each column located in each of the n−1 septum present between adjacent slots.

* * * * *